US011992144B1

(12) United States Patent
Estep

(10) Patent No.: US 11,992,144 B1
(45) Date of Patent: May 28, 2024

(54) PILLOWCASE POSITIONING DEVICE

(71) Applicant: Helen Estep, Palm City, FL (US)

(72) Inventor: Helen Estep, Palm City, FL (US)

( * ) Notice: Subject to any disclaimer, the term of this patent is extended or adjusted under 35 U.S.C. 154(b) by 0 days.

(21) Appl. No.: 18/192,511

(22) Filed: Mar. 29, 2023

(51) Int. Cl.
*A47G 9/02* (2006.01)

(52) U.S. Cl.
CPC ..... *A47G 9/0253* (2013.01)

(58) Field of Classification Search
CPC ..... A47G 9/0253; A47C 21/028; B65B 67/1238; B65D 33/007
See application file for complete search history.

(56) References Cited

U.S. PATENT DOCUMENTS 359,617 A * 3/1887 Leonard ..... A47C 21/028 5/489
804,456 A * 11/1905 Condo ..... A47C 21/028 5/489
827,008 A * 7/1906 Gilmore ..... A47C 21/028 5/489
1,087,702 A * 2/1914 Van Patten ..... B65D 33/007 220/904
1,275,205 A * 8/1918 Bigham et al. ..... A47G 9/0253 5/490
1,712,711 A * 5/1929 Morgan ..... A47G 9/0253 5/489
3,373,963 A * 3/1968 Snell ..... B65B 67/1238 248/153
3,983,914 A * 10/1976 Benson ..... B65B 67/1238 141/390
4,287,701 A * 9/1981 Washington ..... B65B 67/1238 141/390
4,749,011 A * 6/1988 Rylander ..... B65B 67/1238 141/390
5,239,741 A * 8/1993 Shamos ..... B21D 51/52 493/379
5,673,446 A * 10/1997 Moen ..... A47C 21/028 5/489
5,716,033 A * 2/1998 Gibson ..... B65B 67/1238 248/152
5,879,039 A * 3/1999 Baker ..... B65B 67/1238 141/390
6,065,512 A * 5/2000 Munn, II ..... B65B 67/12 141/10
6,340,037 B1 * 1/2002 Stafford ..... B65B 67/1205 141/391

(Continued)

*Primary Examiner* — Eric J Kurilla
(74) *Attorney, Agent, or Firm* — Mammen (Roy) P. Zachariah; Greenberg Traurig, LLP

(57) ABSTRACT

A device for positioning a case on an object, such as a pillow, is disclosed. The device may include handles on a top portion of the device, a first fastener on an inside portion of a first side of the device, and a second fastener on an outside portion of a second side of the device. An object is positioned on an inside surface of the device and the first and second sides are folded over the object. The fasteners of the first and second sides are secured together such that the device is in a closed configuration and the object is secured within the device. A case is positioned over the device and the object. When the handles are grabbed and pulled while grabbing onto a portion of the object and/or a portion of the case, the device is removed away, thereby leaving the pillowcase positioned over the object.

20 Claims, 28 Drawing Sheets

(56) References Cited

U.S. PATENT DOCUMENTS

| | | | | |
|---|---|---|---|---|
| 6,839,923 | B2 * | 1/2005 | Blessman | A47G 9/0253 5/636 |
| 7,958,580 | B2 * | 6/2011 | Zorger | A47G 9/0253 5/489 |
| 7,971,294 | B1 * | 7/2011 | Murauskos | A47G 9/0253 5/489 |
| 9,713,390 | B1 * | 7/2017 | Charters | A47G 9/0253 |
| 9,833,082 | B1 * | 12/2017 | Rutkowski | A47G 9/0253 |
| 10,178,920 | B2 * | 1/2019 | Verma | A47C 21/028 |
| 10,980,350 | B1 * | 4/2021 | Hutchings | A47C 21/028 |
| D953,777 | S * | 6/2022 | Estep | D6/607 |
| 2006/0185086 | A1 * | 8/2006 | Lucas | A47G 9/0253 5/489 |
| 2007/0187558 | A1 * | 8/2007 | Blodgett | B65B 67/1238 248/95 |
| 2009/0144901 | A1 * | 6/2009 | Zorger | A47G 9/0253 5/489 |
| 2012/0219241 | A1 * | 8/2012 | Horton | B65D 33/007 383/34 |
| 2018/0098646 | A1 * | 4/2018 | Verma | B25J 15/0028 |
| 2018/0266046 | A1 * | 9/2018 | Barre | B65B 67/125 |
| 2020/0095002 | A1 * | 3/2020 | Willis | B65F 1/1415 |

* cited by examiner

PILLOWCASE POSITIONING DEVICE

FIELD OF THE INVENTION

The present application relates to pillowcase positioning technologies, pillow technologies, pillowcase technologies, pillow covers, assistance devices, and more particularly, to a pillowcase positioning device and method for positioning a pillowcase on a pillow.

BACKGROUND

Currently, users typically position pillowcases or other types of covers onto pillows to preserve the durable life of the pillow and to provide a barrier between the user's head and the pillow when the user is sleeping or resting on the pillow. Pillowcases are also convenient because pillowcases may be removed and washed without having to wash the pillows themselves, which are significantly more difficult to clean. Additionally, users like using pillowcases to cover pillows because it is easier to match the pillowcases with the bed sheets or furniture in the room than attempting to match the pillows. Despite the foregoing benefits of pillowcases, positioning a pillowcase or cover onto a pillow can often be a frustrating task. For example, a user often has to squeeze a pillow into the pillowcase and shake and manipulate the pillow into the pillowcase to in order to fully cover the pillow with the pillowcase. As another example, certain users may use their chins or teeth to hold a pillow so that they can insert the pillow into a pillowcase using both of their hands. The difficulty in positioning a pillow into a pillowcase is often the result of the pillow and pillowcases being made of similar materials and/or materials that readily cling to each other.

In order to resolve the difficulty of positioning a pillow into a pillowcase, various types of products and/or processes have been developed to assist users with inserting pillows into pillowcases. For example, products exist that are made of hard preformed plastic or spring-like plastic, which, when used, one must have substantial strength for squeezing, grasping, and compressing various components of the products so as to connect interlocking components of the products together to facilitate the positioning of a pillow into a pillowcase. In many instances, users can often pinch their fingers, pinch their forearm skin, scratch themselves, or even injure themselves using such difficult-to-use and rigid products. Other products include the use of J-hooks and/or hook-and-loop fasteners for compressing the pillow, however, such products do not allow for a smooth pull of the pillowcase over the pillow or cause the pillowcase to snag on various components of the products themselves. Still further products, such as those found in U.S. Pat. No. 6,839,923, involve using a u-shaped cavity and squeezing together a plastic sheet to insert into a pillowcase, and then shoving the pillow into an open cavity and then reinserting ones' arms to an extended length to squeeze again to release pressure and remove a plastic insertion device. Other variants include using tubular plastic that is inserted into a pillowcase using a loop and/or string to pull the pillow inserter out of the pillowcase itself.

While current products and methodologies provide for certain benefits, there is still room to provide further enhancements for pillowcase positioning technologies. In particular, current versions of such products often provide limited and/or frustrating mechanisms for positioning a pillowcase onto a pillow and/or inserting a pillow into a pillowcase. Additionally, current products are often difficult to use, impractical, cumbersome, expensive, or a combination thereof. As a result, current products and methodologies associated with positioning pillowcases onto pillows or inserting pillows into pillowcases may be modified and/or enhanced to provide a more effective manner in which to position a pillowcase onto a pillow. Such enhancements and improvements to methodologies and products may provide for lower user frustration, a more enjoyable way in which to position pillowcases onto pillows, reduced costs, and substantially increased ease-of-use.

SUMMARY

Devices and accompanying methods for positioning or placing a case onto an object, such as a pillow, is disclosed. In particular, the pillowcase positioning devices and methods may assist a user to insert a pillow into a pillowcase in an easy, rapid, and enjoyable fashion. The devices disclosed in the present disclosure may be made of materials that are smooth and/or slick in nature, such as, but not limited to, vinyl, plastics, and/or other materials, which assist in reducing the friction between a pillow and pillowcase when positioning a pillow into the pillowcase. Additionally, in certain embodiments, versions of the devices disclosed in the present disclosure may be configured to include handles or other components to assist a user to hold onto the pillowcase positioning device itself. The pillowcase positioning devices may be configured to be durable for numerous years of use, be lightweight and compact for storing and/or shipping, and be stored underneath a mattress or bedframe. In certain embodiments, the pillowcase positioning devices may be readily cleaned and/or sanitized after each use to prevent the spread of germs, diseases, and/or dust, particularly in hospitals, medical institutions, and/or nursing facilities.

Notably, in certain embodiments, the pillowcase positioning devices may be utilized to position a pillowcase evenly and securely onto a pillow using a single pulling action. The pillowcase positioning devices and methodologies disclosed in the present disclosure also eliminate the need to shake a pillow into a pillowcase and reduce the prevalence of dust being dispersed into the air. Additionally, the pillowcase positioning devices and methodologies eliminate the need for users to use their chin or teeth to hold a pillow when inserting a pillow into a pillowcase. The devices and methodologies also eliminate the possibility of one scratching his or her arms, hands, and/or other body parts as one might do using conventional products and methodologies. Furthermore, the devices and methodologies are configured to be helpful for those with wrist, hand, or other disabilities to position a pillowcase onto a pillow. The simplicity of the devices and methodologies are designed to be easy and safe for all ages to use, and because the devices are efficient, durable, and easily cleaned so that the devices are an ideal solution for hospitals, hotels, and/or homes.

In certain embodiments, a pillowcase positioning device for facilitating the placement of a pillowcase onto a pillow or inserting a pillow into a pillowcase is provided. The pillowcase positioning device may be configured to be rectangular or square-like in shape (or other desired shape) and may be constructed of plastic, vinyl, and/or any other suitable material (e.g., a low friction material) that may assist in reducing friction when positioning the pillowcase onto the pillow or inserting the pillow into the pillowcase. In certain embodiments, the pillowcase positioning device may have sealed left and right sides, an open base portion, and a top portion that has a pair of sealed shoulder portions and a notch cut (V-shaped, U-shaped or other desired notch shape) into the top portion that resides between the sealed shoulder portions. A pillow may be inserted into the opening of the base portion and positioned through the pillowcase positioning device until the top end of the pillow touches the shoulder portions of the top portion of the device and a portion of the top end of the pillow is exposed via the notch located at the top portion of the pillowcase positioning device. A user may then easily place a pillowcase over the device and then place her hand over the portion of the pillowcase covering the notch of the top portion of the device. The user may then grab the portion of the pillow located in the notch located at the top portion of the device with one hand and grab the base portion of the device with another hand. While grabbing the portion of the pillow located in the notch, the user may then pull the base portion of the device with a single pulling action to cause the shoulders of the device to become unsealed and cause the device to be removed from the pillow, thereby causing the pillowcase to be perfectly positioned onto the pillow.

In certain embodiments, another pillowcase positioning device is provided. In certain embodiments, the pillowcase positioning device may include a pair of handles located on a top portion (or end) of the pillowcase positioning device, a side handle located on a first side of the pillowcase positioning device, a first fastener located on an inside portion of the first side of the device and in proximity to the side handle, and a second fastener on an outside portion of a second side of the pillowcase positioning device. In certain embodiments, a pillow may be configured to be positioned on an inside surface of the pillowcase positioning device. In certain embodiments, the first side of the pillowcase positioning device may be folded over the pillow and the second side may be folded over the pillow. In certain embodiments, the first fastener may be secured to the second fastener to secure the pillow within the pillow positioning device. In certain embodiments, a pillowcase may be configured to be positioned over the pillowcase positioning device while the pillow is within the pillow positioning device. When at least one handle of the pair of handles is grabbed and pulled while grabbing onto a portion of the pillow or a portion of the pillowcase located opposite the pair of handles, the pillowcase positioning device may be removed away from the pillow and the pillowcase, thereby leaving the pillowcase positioned over the pillow.

A method for utilizing a pillowcase positioning device to position a pillowcase onto a pillow is provided. In certain embodiments, the method may include laying a pillowcase positioning device in an open configuration on a surface. In certain embodiments, the method may include positioning a pillow onto an inside surface of the pillowcase positioning device. In certain embodiments, the method may include covering the pillow by folding over first and second sides of the pillowcase positioning device on top of each other. In certain embodiments, the method may include securing the first and second sides of the pillowcase positioning device together via a fastener to secure the pillow within the pillowcase positioning device. In certain embodiments, the method may include grabbing onto at least one handle located at a top portion (or end) of the pillowcase positioning device. In certain embodiments, the method may include grabbing onto an end of the pillowcase, an end of the pillow, or a combination thereof, that are in proximity to a bottom portion of the pillowcase positioning device that is opposite to the top portion (or end). In certain embodiments, the method may include pulling the pillowcase positioning device via the at least one handle while maintaining a grip onto the end of the pillowcase, the end of the pillow, or a combination thereof, such that the pillowcase positioning device is removed away from the pillowcase and the pillow, thereby leaving the pillowcase covering the pillow.

In certain embodiments, yet another pillowcase positioning device is provided. In certain embodiments, the pillowcase positioning device may include one or more handles located on a top portion (or end) of the pillowcase positioning device, a first fastener located on an inside portion of a first side of the device, and a second fastener on an outside portion of a second side of the pillowcase positioning device. In certain embodiments, a pillow may be configured to be positioned on an inside surface of the pillowcase positioning device. In certain embodiments, the first side may be folded over the pillow and the second side may be folded over the pillow. In certain embodiments, the first fastener may be secured to the second fastener such that the pillowcase positioning device is in a closed configuration and the pillow is secured within the pillow positioning device. In certain embodiments, the pillowcase may be configured to be positioned over the pillowcase positioning device while the pillow is within the pillow positioning device. In certain embodiments, when the at one or more handles are grabbed and pulled while grabbing onto a portion of the pillow or a portion of the pillowcase located opposite the at least one handle, the pillowcase positioning device may be removed away from the pillow and the pillowcase, thereby leaving the pillowcase positioned over the pillow.

These and other features of the devices and methods for positioning a pillowcase onto an object, such as a pillow, are described in the following detailed description, drawings, and appended claims.

DETAILED DESCRIPTION OF THE DRAWINGS

Figure 1:
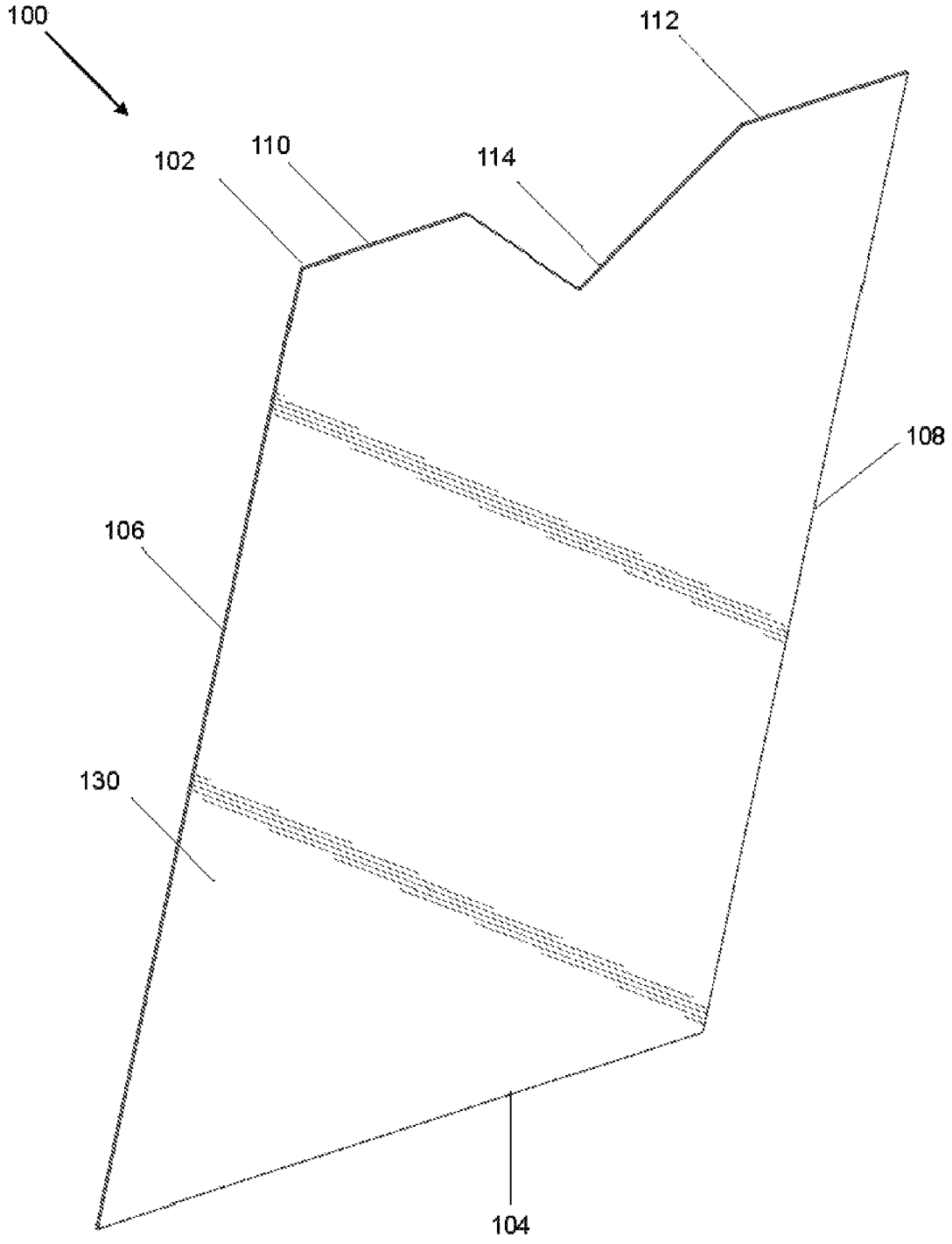
FIG. 1 is a front perspective view of a pillowcase positioning device for positioning a pillowcase on an object, such as a pillow, according to embodiments of the present disclosure.
Figure 2:
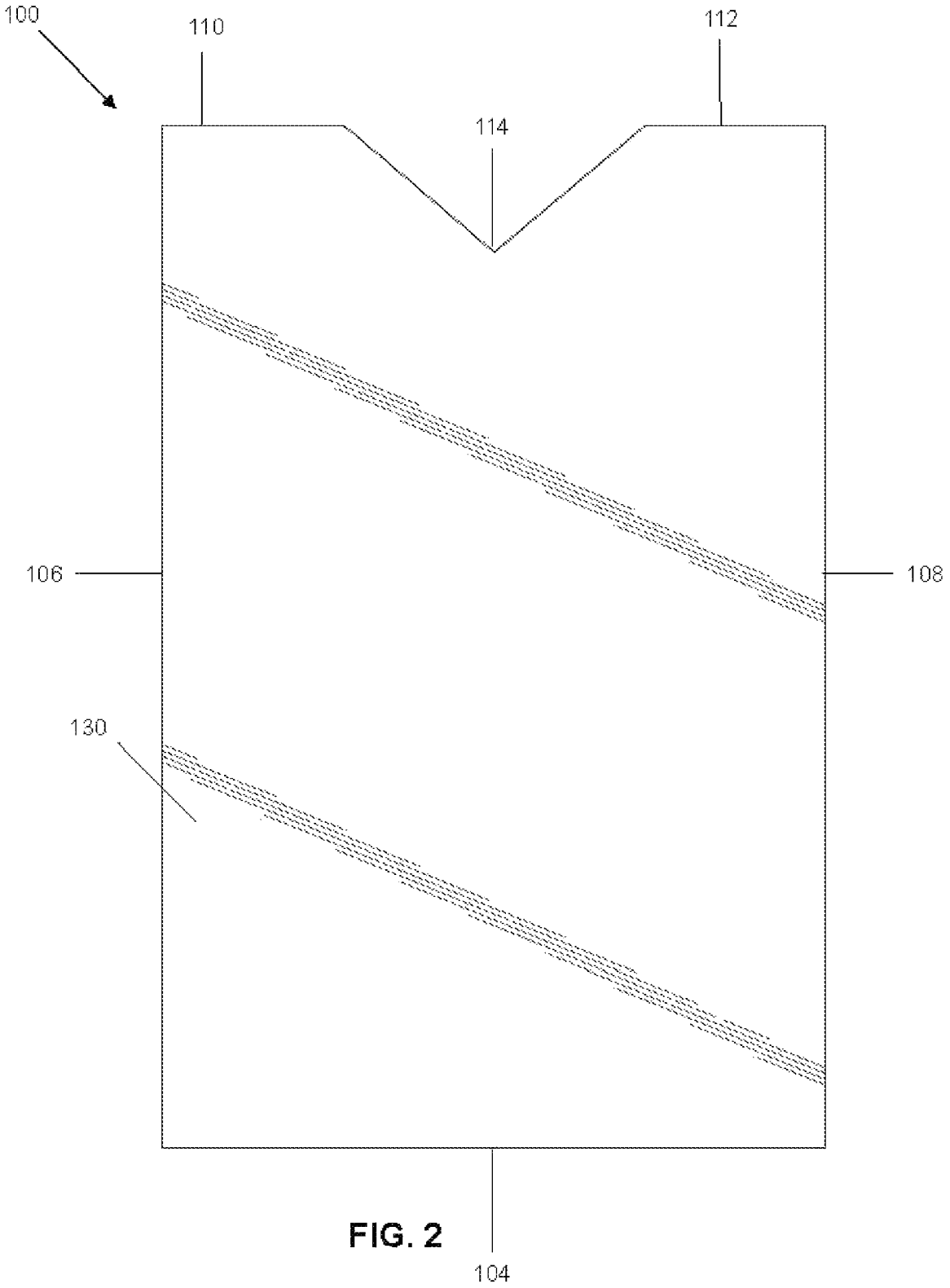
FIG. 2 is front view of the device of FIG. 1 according to embodiments of the present disclosure.
Figure 3:
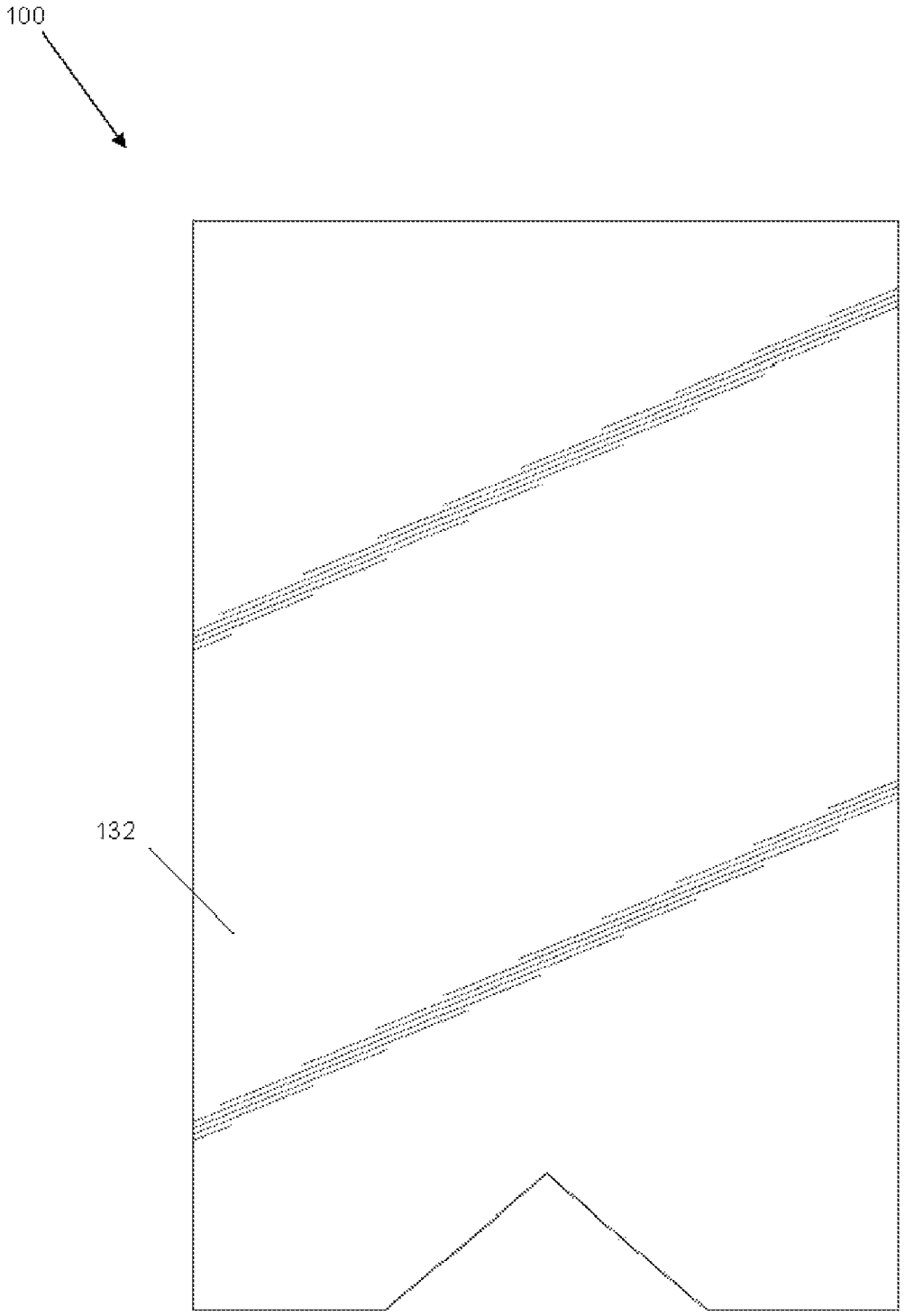
FIG. 3 is an alternate front view of the device of FIG. 1 according to embodiments of the present disclosure.
Figure 4:
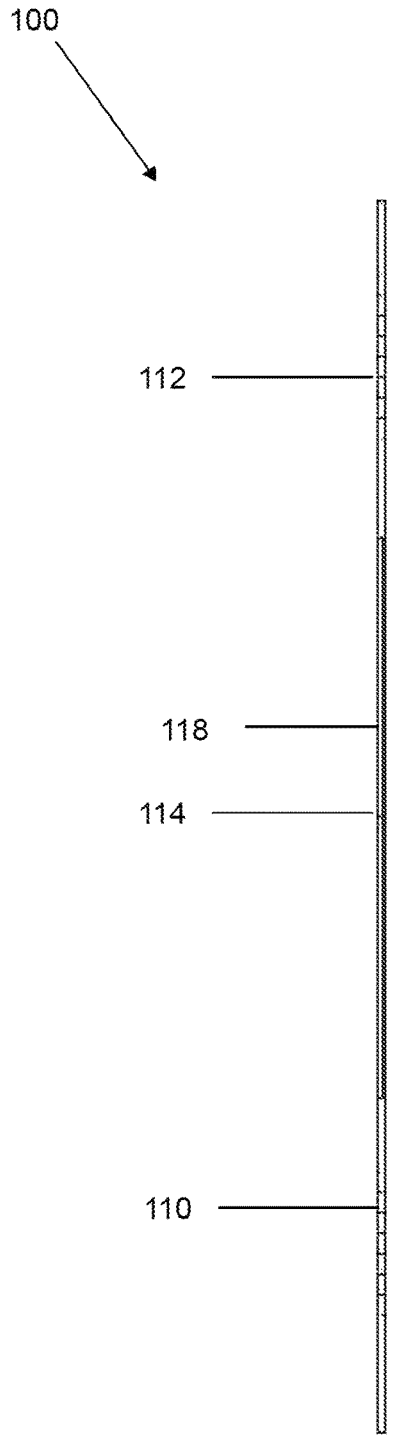
FIG. 4 is top view of the device of FIG. 1 according to embodiments of the present disclosure.
Figure 5:
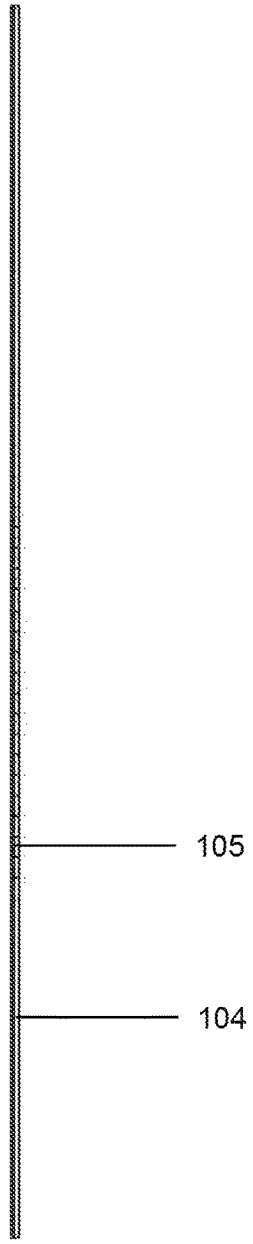
FIG. 5 is a bottom view of the device of FIG. 1 according to embodiments of the present disclosure.
Figures 6, 7:
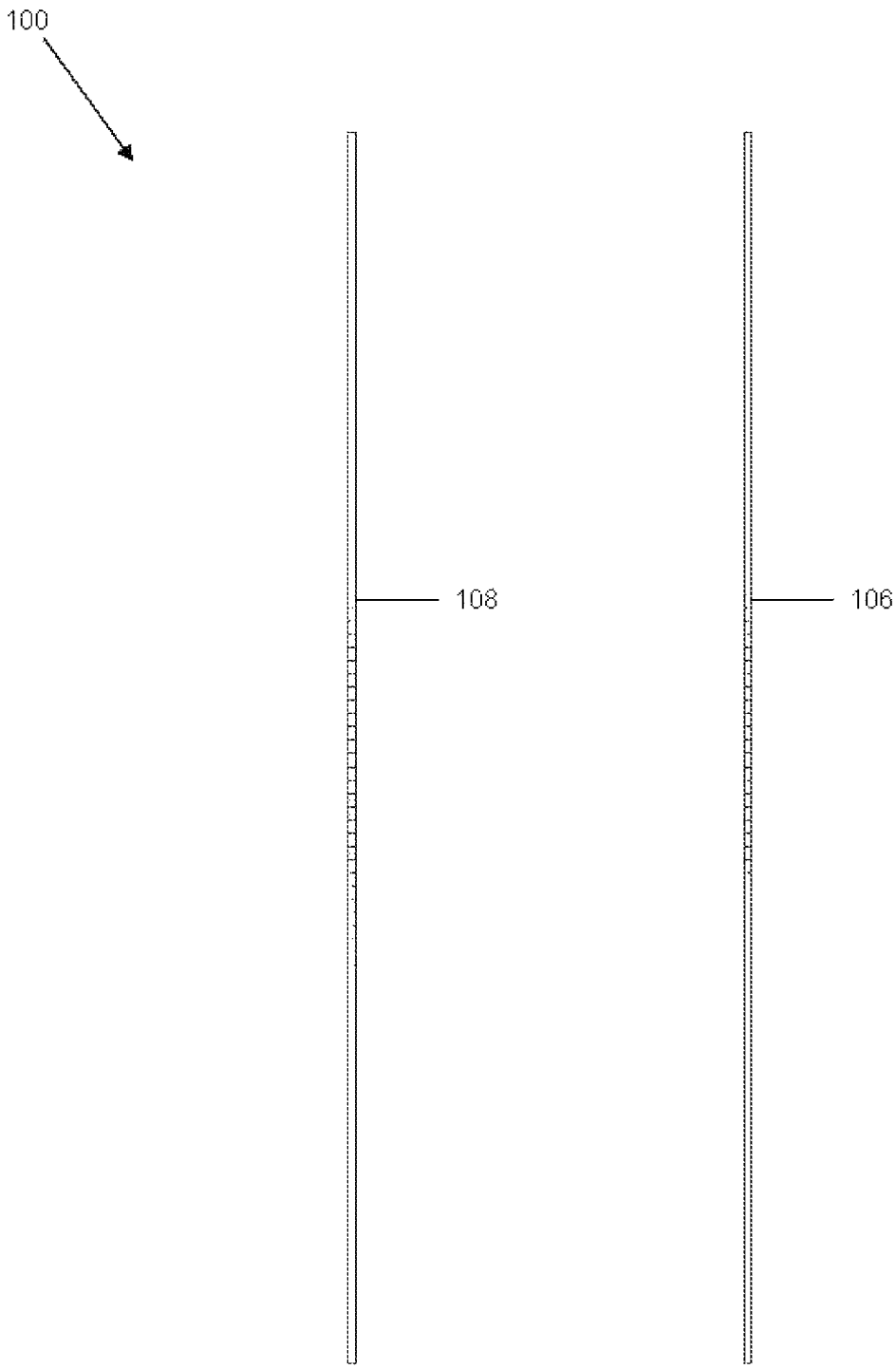
FIG. 6 is a right-side view of the device of FIG. 1 according to an embodiment of the present disclosure.
FIG. 7 is a left side view of the device of FIG. 1 according to n embodiments of the present disclosure.
Figure 8:
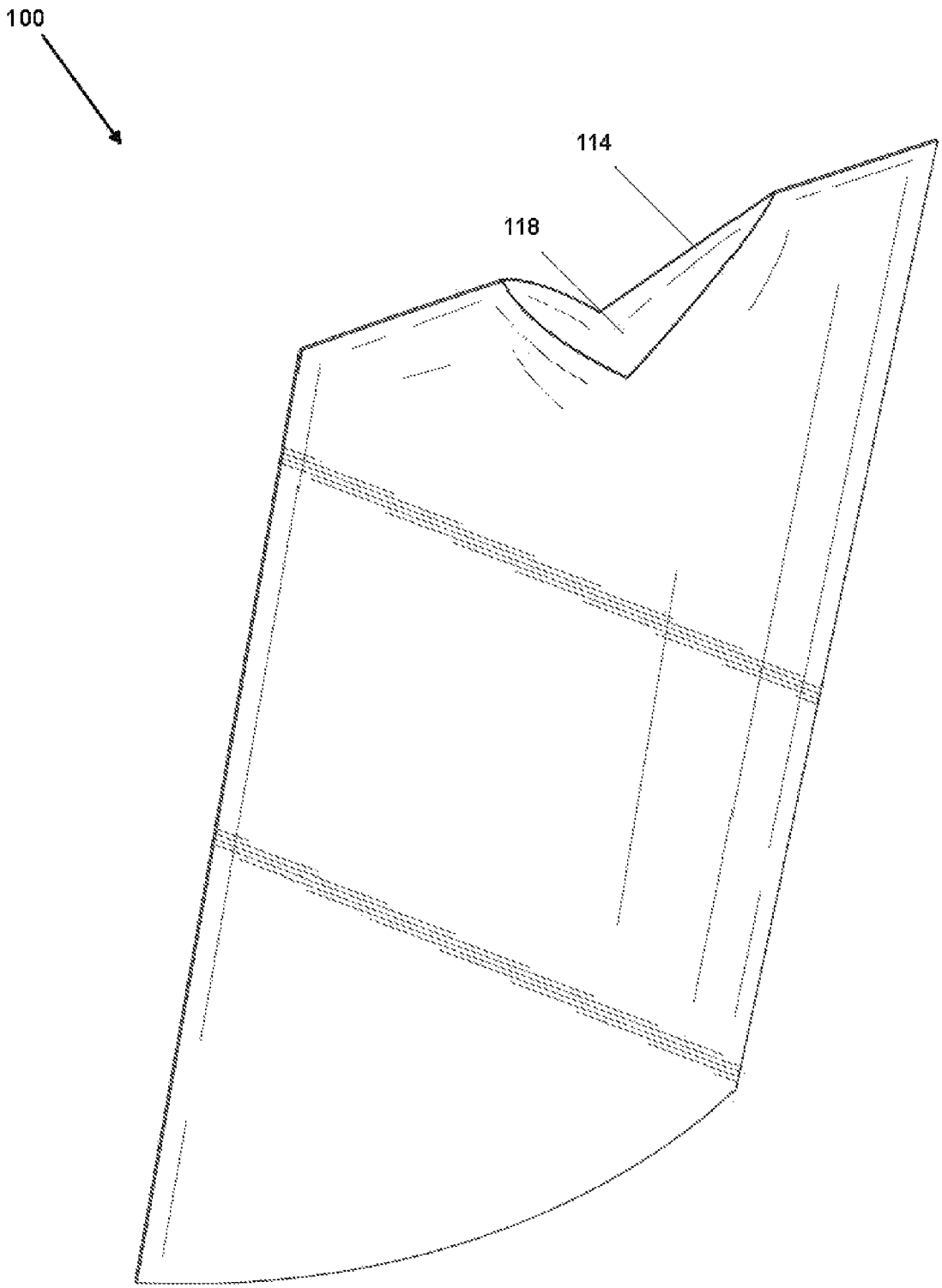
FIG. 8 is a perspective view of the device of FIG. 1 according to embodiments of the present disclosure that features the device in a partially opened state.
Figure 9:
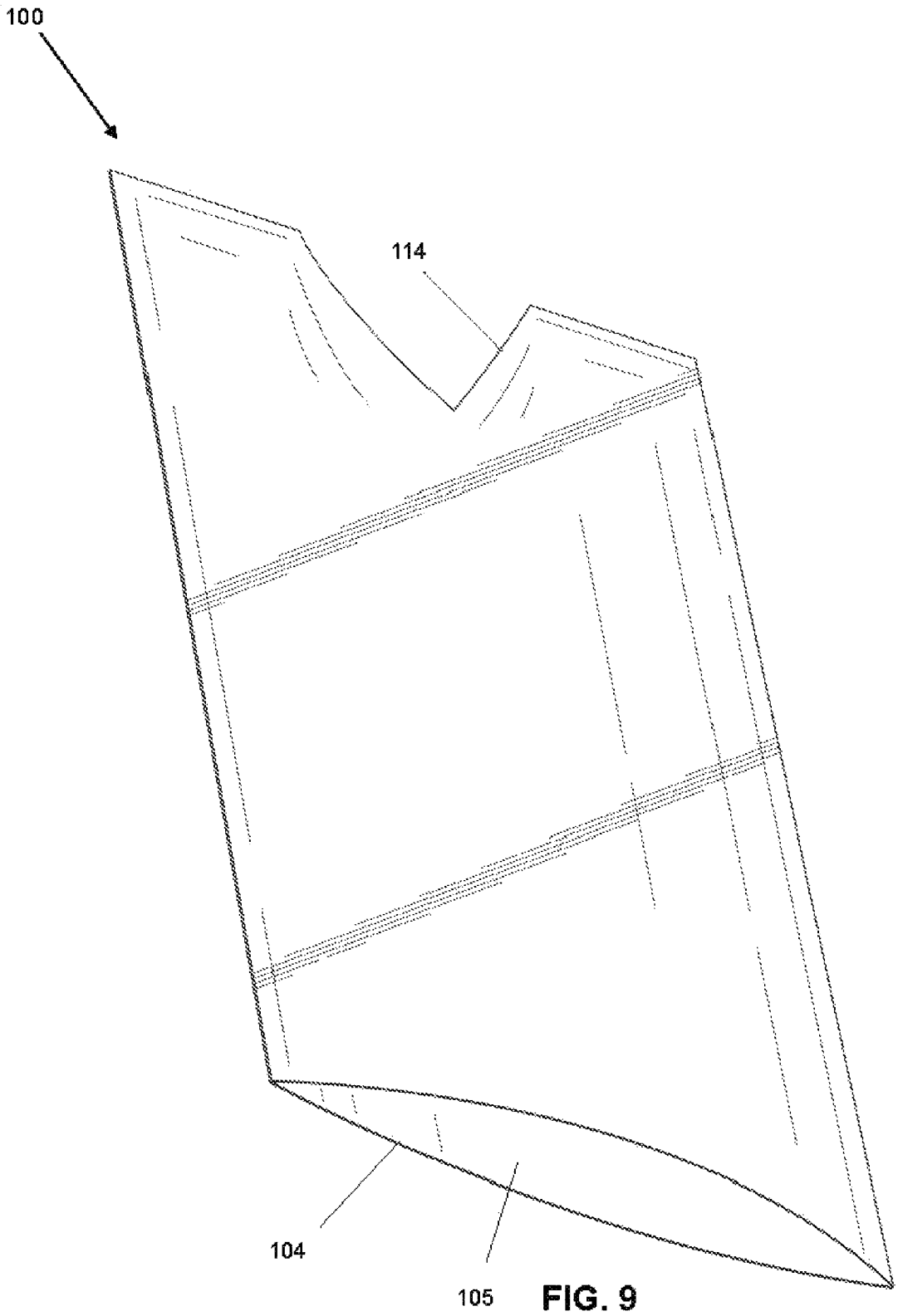
FIG. 9 is an alternative perspective view the device of FIG. 1 according to embodiments of the present disclosure that features the device in a partially opened state.
Figure 10:
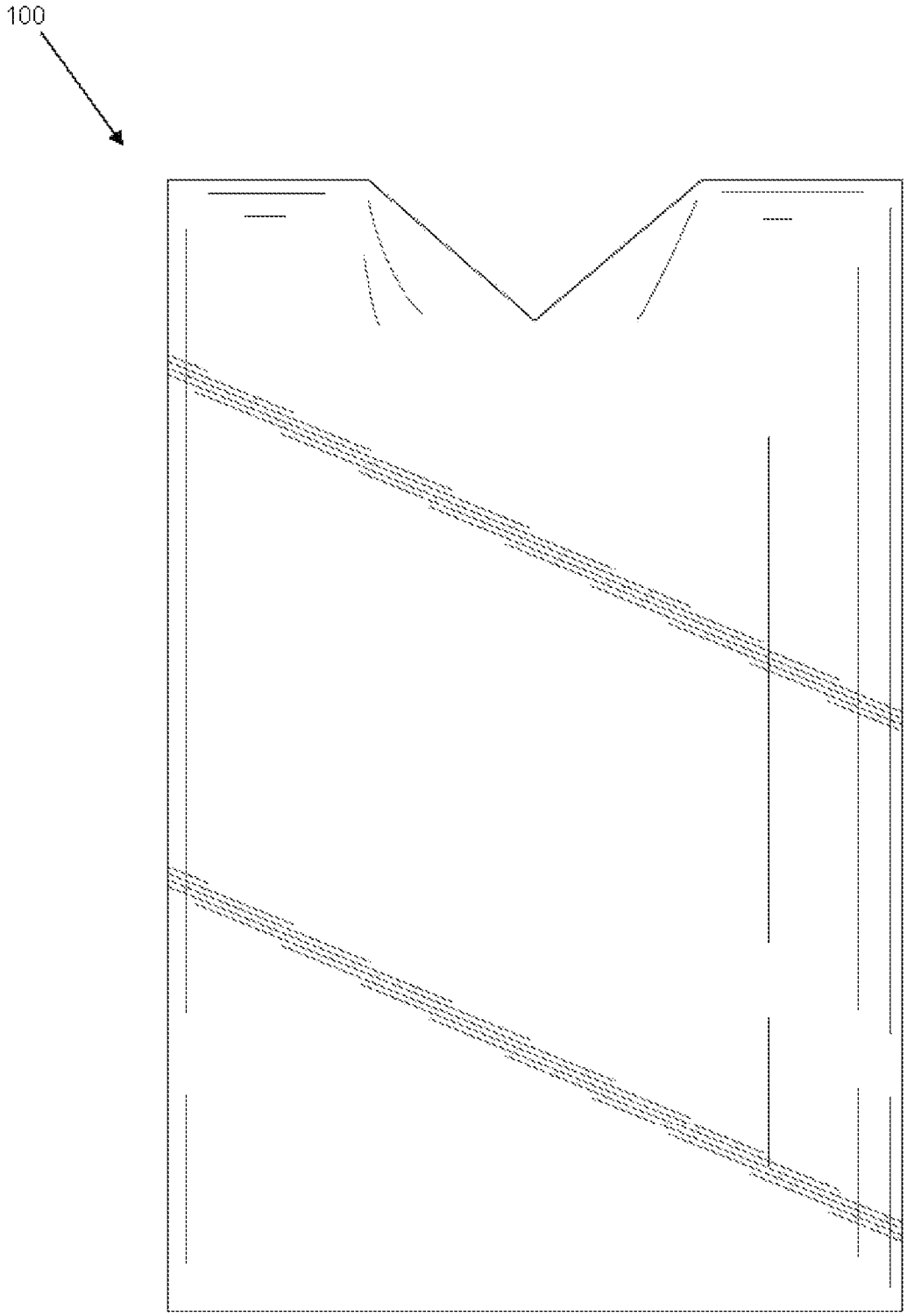
FIG. 10 is a front view of the device of FIG. 1 according to embodiments of the present disclosure that features the device in a partially opened state.
Figure 11:
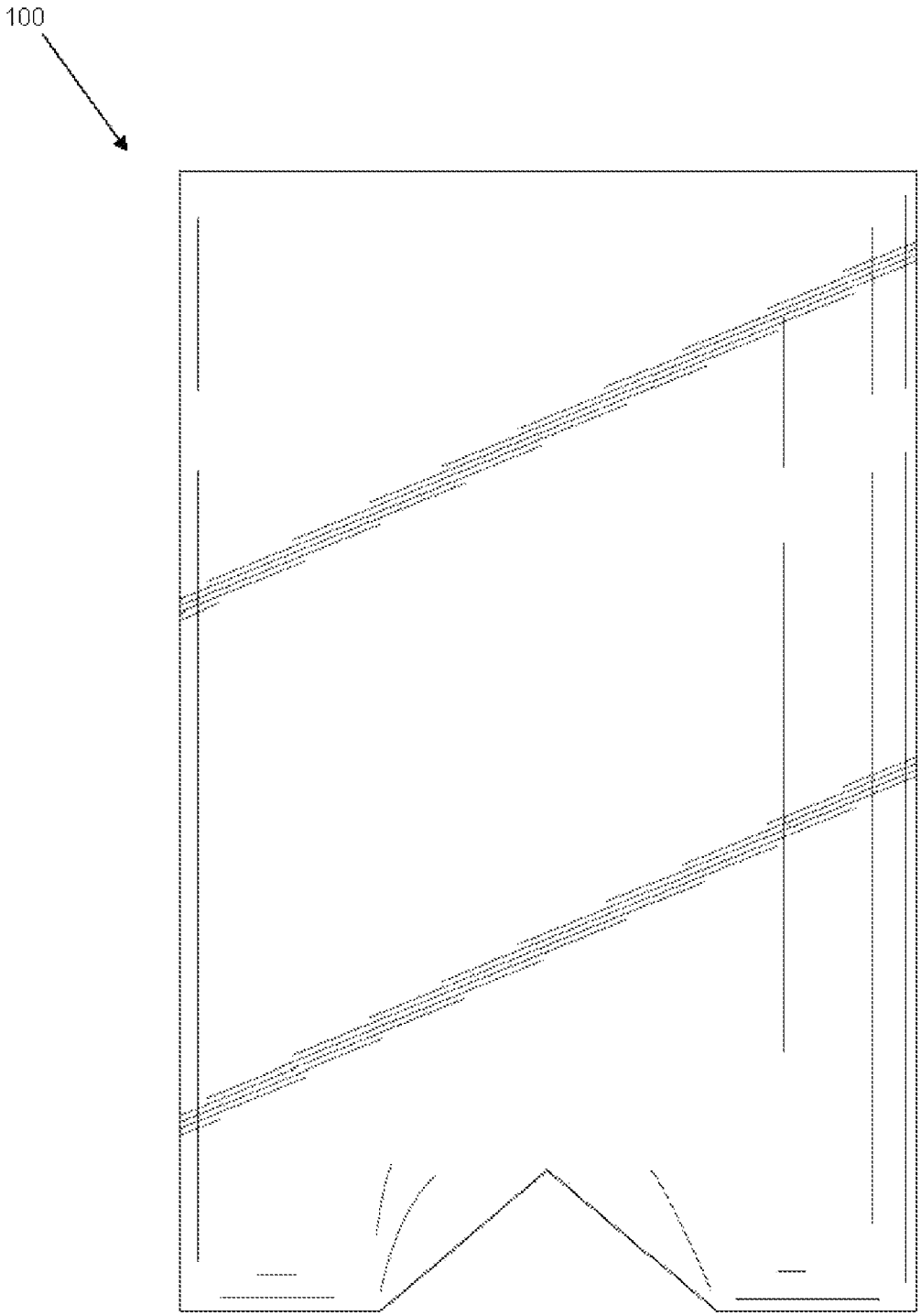
FIG. 11 is an alternate front view of the device of FIG. 1 according to embodiments of the present disclosure that features the device in a partially opened state.
Figures 12, 13:
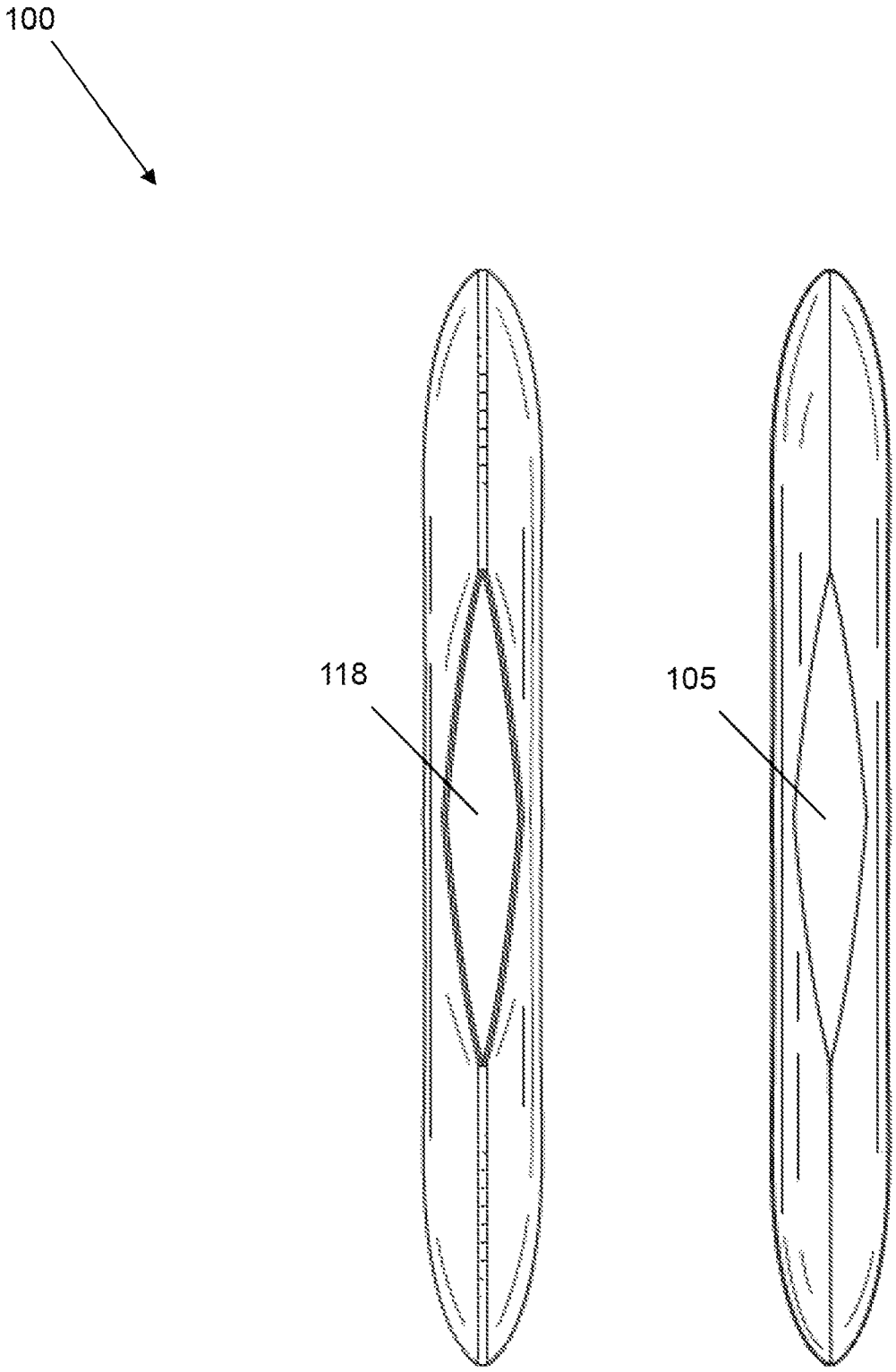
FIG. 12 is a top view of the device of FIG. 1 according to embodiments of the present disclosure that features the device in a partially opened state.
FIG. 13 is a bottom view of the device of FIG. 1 according to embodiments of the present disclosure that features the device in a partially opened state.
Figures 14, 15:
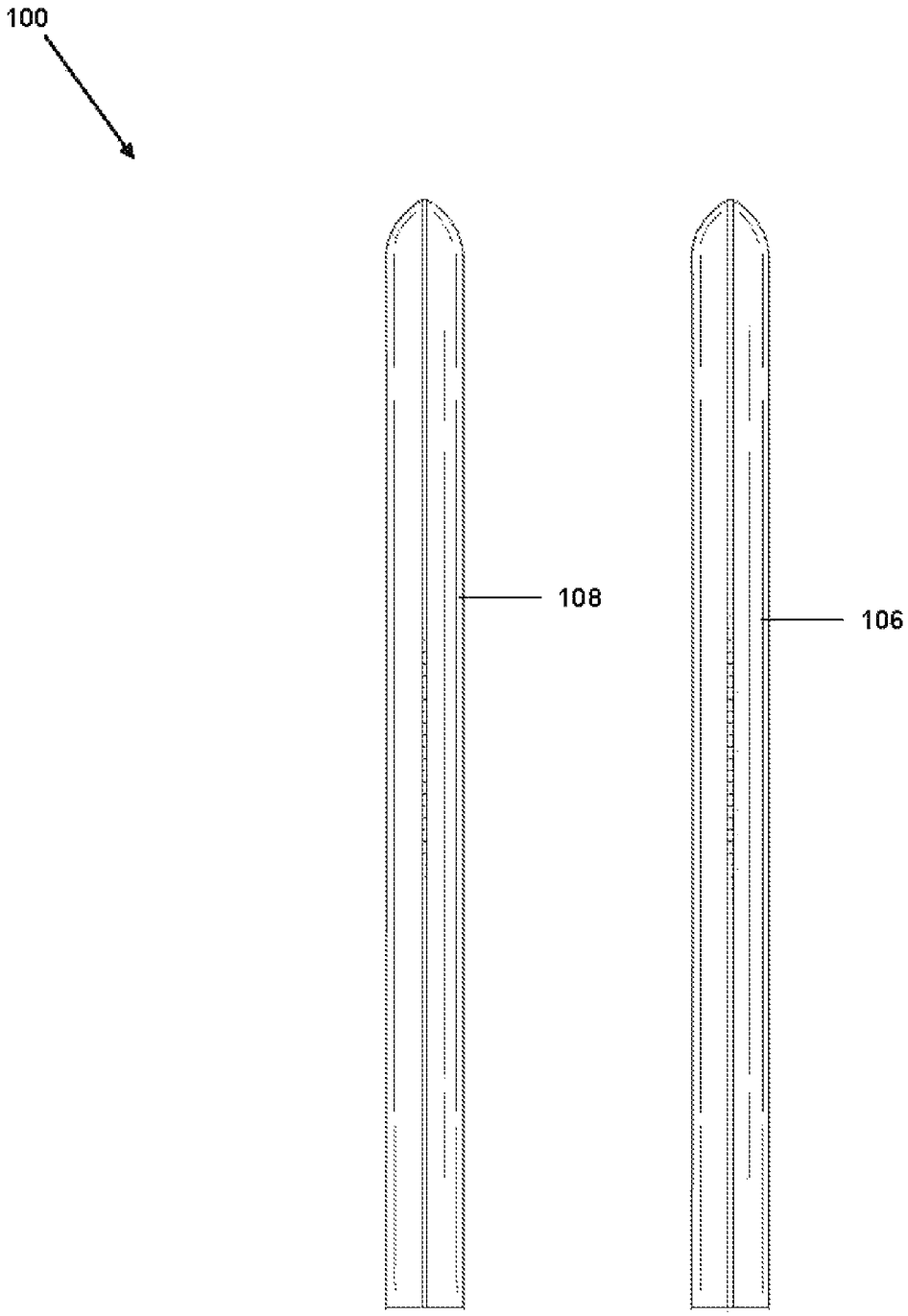
FIG. 14 is a right-side view of the device of FIG. 1 according to embodiments of the present disclosure that features the device in a partially opened state.
FIG. 15 is a left side view of the device of FIG. 1 according to embodiments of the present disclosure that features the device in a partially opened state.
Figure 16:
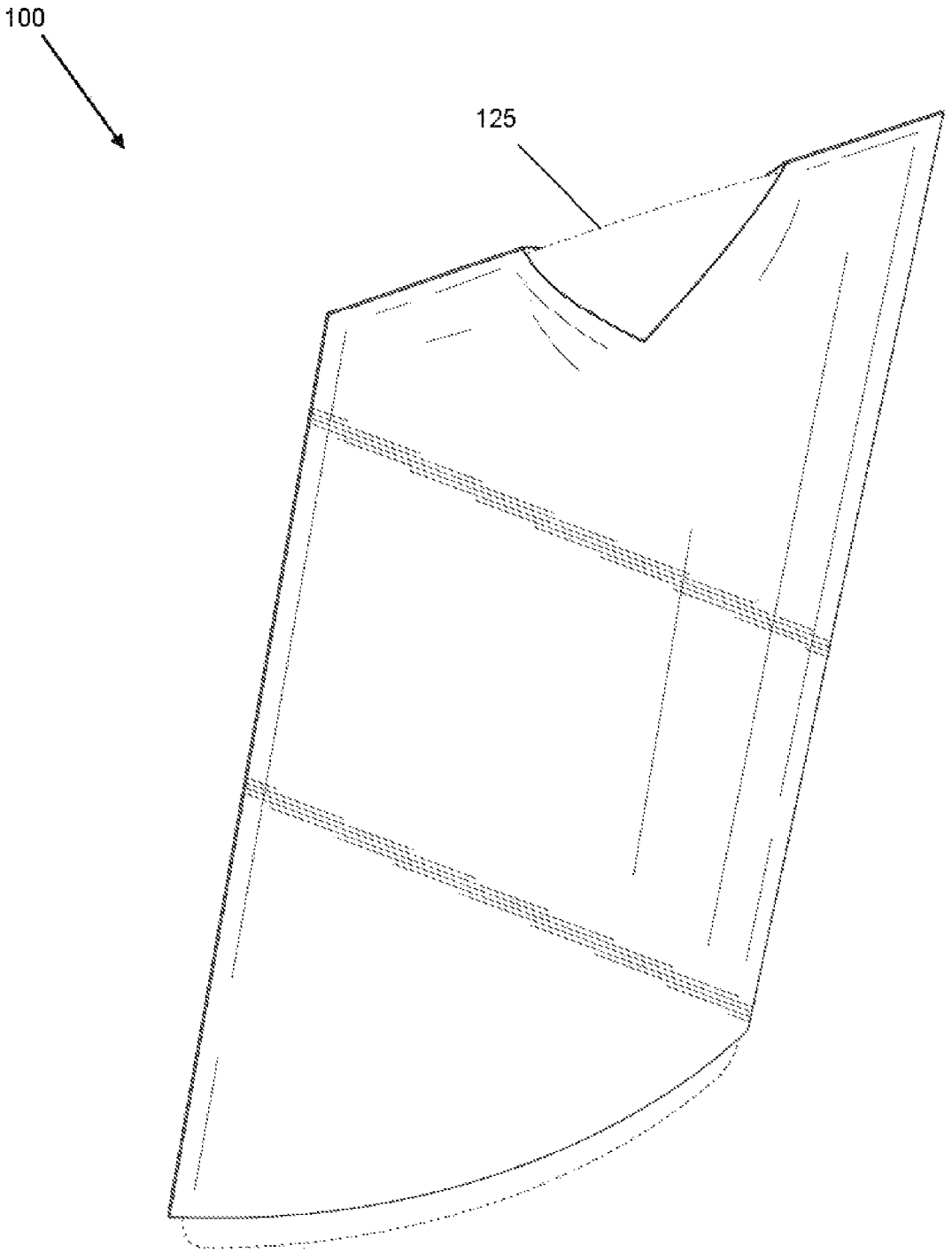
FIG. 16 is a perspective view of the device of FIG. 1 according to embodiments of the present disclosure that features a pillow inserted into the device.

Devices 100, 200, and 300 and accompanying methods (e.g. method 3600) for placing or positioning a case onto an object, such as a pillow, is disclosed. In particular, the devices 100, 200, and 300, and methods may assist a user in inserting a pillow into a pillowcase in an easy, rapid, and enjoyable fashion. The devices 100, 200, and 300 disclosed in the present disclosure may be made of materials that are smooth and/or slick in nature, such as, but not limited to, vinyl, plastics, and/or other materials, which assist in reducing the friction between a pillow and pillowcase when positioning a pillow into the pillowcase. Additionally, in certain embodiments, versions of the devices 100, 200, and 300 disclosed in the present disclosure may be configured to include handles or other components to assist a user to hold onto the device itself. The devices 100, 200, and 300 may be configured to be durable for numerous years of use, be lightweight and compact for storing and/or shipping, can be stored underneath a mattress or bedframe. In certain embodiments, the devices 100, 200, and 300 may be readily cleaned and/or sanitized after each use to prevent the spread of germs, diseases, and/or dust, particularly in hospitals, medical institutions, and/or nursing facilities.

Notably, in certain embodiments, the devices 100, 200, and 300 may be utilized to position a pillowcase evenly and securely onto a pillow using a single pulling action. The devices 100, 200, and 300 and methodologies disclosed in the present disclosure also eliminate the need to shake a pillow into a pillowcase and reduce the prevalence of dust being dispersed into the air. Additionally, the devices 100, 200 and 300 and methodologies eliminate the need for users to use their chin or teeth to hold a pillow when inserting a pillow into a pillowcase. The devices 100, 200, and 300 and methodologies also eliminate the possibility of one scratching his or her arms, hands, and/or other body parts as one might do using conventional products and methodologies. Furthermore, the devices 100, 200, and 300 and methodologies are configured to be helpful for those with wrist, hand, or other disabilities to position a pillowcase onto a pillow. The simplicity of the devices 100, 200, and 300, and methodologies are designed to be easy and safe for all ages to use, and the fact that the devices are efficient, durable, and easily cleaned or sanitized make the devices an ideal solution for hospitals, hotels, and/or homes.

In certain embodiments, a pillowcase positioning device is provided. In certain embodiments, the pillowcase positioning device may include a pair of handles located on a top portion of the pillowcase positioning device and a side handle located on a first side of the pillowcase positioning device. In certain embodiments, the pillowcase positioning device may include a first fastener located on an inside portion of the first side of the device and in proximity to the side handle, and a second fastener on an outside portion of a second side of the pillowcase positioning device. In certain embodiments, a pillow may be configured to be positioned on an inside surface of the pillowcase positioning device. In certain embodiments, the first side may be folded over the pillow and the second side may be folded over the pillow. In certain embodiments, the first fastener may be secured to the second fastener to secure the pillow within the pillow positioning device. In certain embodiments, a pillowcase may be configured to be positioned over the pillowcase positioning device while the pillow is within the pillow positioning device. In certain embodiments, when at least one handle of the pair of handles is grabbed and pulled while grabbing onto a portion of the pillow or a portion of the pillowcase located opposite the pair of handles, the pillowcase positioning device may be removed away from the pillow and the pillowcase, thereby leaving the pillowcase positioned over the pillow.

In certain embodiments, a first handle of the pair of handles may be located in proximity to an end of the top portion, and the second handle of the pair may be located in proximity to a center of the top portion. In certain embodiments, the side handle may be located in proximity to a center of the first side of the pillowcase positioning device. In certain embodiments, the pillowcase positioning device may include a plurality of slats configured to be adjacent to each other and configured to form the pillowcase positioning device. In certain embodiments, the pillowcase positioning device may include a third fastener located on the inside portion of the first side and parallel to the first fastener. In certain embodiments, the pillowcase positioning device may include a fourth fastener located on the outside portion of the second side and parallel to the second fastener. In certain embodiments, the third fastener may be configured to secure to the fourth fastener. In certain embodiments, when the first side is folded over the pillow and the second side is folded over the pillow and the first fastener is secured to the second fastener to secure the pillow within the pillow positioning device, the pillowcase positioning device may be in a closed configuration. In certain embodiments, when the first side is not folded over the pillow and the second side is not folded over the pillow and the first and second fasteners are not secured to each other, the pillowcase positioning device is in an open configuration.

In certain embodiments, the pillowcase positioning device may be configured to be carried via the pair of handles, the side handle, or a combination thereof. In certain embodiments, the pillowcase positioning device may be configured to serve as a storage device when the first side is folded over and the second side is folded under the first side and the first fastener is secured to the second fastener to secure the first side to the second side such that the pillowcase positioning device may be in a closed configuration, and the pillowcase positioning device is placed on a surface via a bottom portion opposite to the top portion. In certain embodiments, the pillowcase positioning device may include a sealable storage compartment configured to store an article. In certain embodiments, the pillowcase positioning device may include a universal serial bus charger, a power source, or a combination thereof.

In certain embodiments, a method for utilizing a pillowcase positioning device is provided. In certain embodiments, the method may include laying a pillowcase positioning device in an open configuration on a surface. In certain embodiments, the method may include positioning a pillow onto an inside surface of the pillowcase positioning device. In certain embodiments, the method may include covering the pillow by folding over first and second sides of the pillowcase positioning device on top of each other. In certain embodiments, the method may include securing the first and second sides of the pillowcase positioning device together via a fastener to secure the pillow within the pillowcase positioning device. In certain embodiments, the method may include grabbing onto at least one handle located at a top portion of the pillowcase positioning device. In certain embodiments, the method may include grabbing onto an end of the pillowcase, an end of the pillow, or a combination thereof, that are in proximity to a bottom portion of the pillowcase positioning device that is opposite to the top portion. In certain embodiments, the method may include pulling the pillowcase positioning device via the at least one handle while maintaining a grip onto the end of the pillowcase, the end of the pillow, or a combination thereof, such that the pillowcase positioning device is removed away from the pillowcase and the pillow, thereby leaving the pillowcase covering the pillow.

In certain embodiments, the method may include unfastening the first and second sides of the pillowcase positioning device after pulling the pillowcase positioning device via the at least one handle. In certain embodiments, the method may include inserting a different pillow into the pillowcase positioning device after pulling the pillowcase positioning device away from the pillow. In certain embodiments, the method may include adjusting a position of the pillowcase positioning device such that the bottom portion is resting on the surface and so that the pillowcase is in an upright position. In certain embodiments, the method may include positioning a liner or bag into an opening of the pillowcase positioning device while in the upright position, wherein the liner or bag is configured to receive an article. In certain embodiments, the method may include carrying the pillowcase positioning device via a side handle located on the first side or the second side of the pillowcase positioning device.

In certain embodiments, another pillowcase positioning device is provided. In certain embodiments, the pillowcase positioning device may include at least one handle located on a top portion of the pillowcase positioning device, a first fastener located on an inside portion of a first side of the device, and a second fastener on an outside portion of a second side of the pillowcase positioning device. In certain embodiments, a pillow may be configured to be positioned on an inside surface of the pillowcase positioning device. In certain embodiments, the first side may be folded over the pillow and the second side may be folded over the pillow. In certain embodiments, the first fastener may be secured to the second fastener such that the pillowcase positioning device is in a closed configuration and the pillow is secured within the pillow positioning device. In certain embodiments, a pillowcase may be configured to be positioned over the pillowcase positioning device while the pillow is within the pillow positioning device. In certain embodiments, when the at least one handle is grabbed and pulled while grabbing onto a portion of the pillow or a portion of the pillowcase located opposite the at least one handle, the pillowcase positioning device may be removed away from the pillow and the pillowcase, thereby leaving the pillowcase positioned over the pillow.

Figure 17:
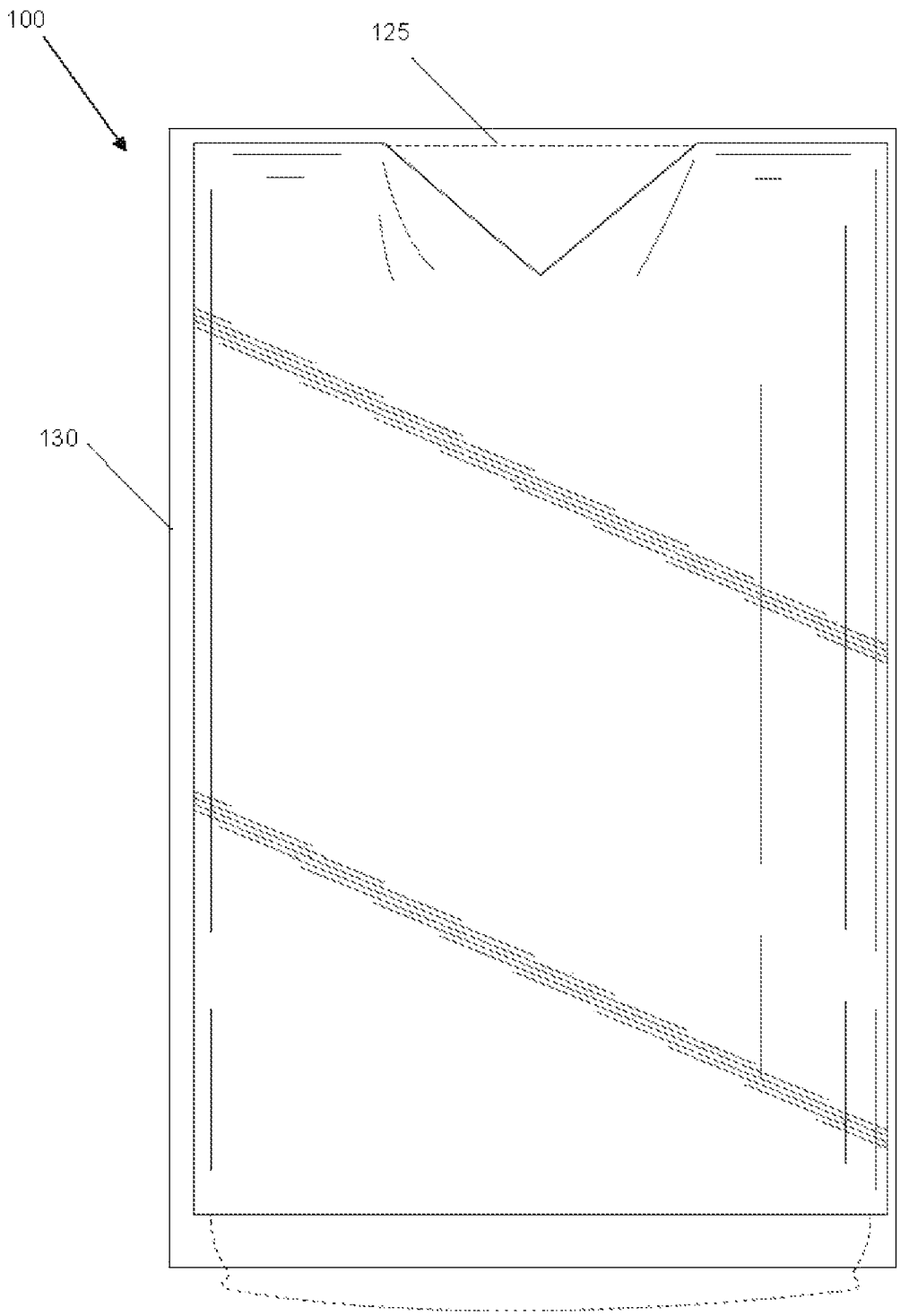
FIG. 17 is a front view of the device of FIG. 1 according to embodiments of the present disclosure that features a pillow inserted into the device.
Figure 18:
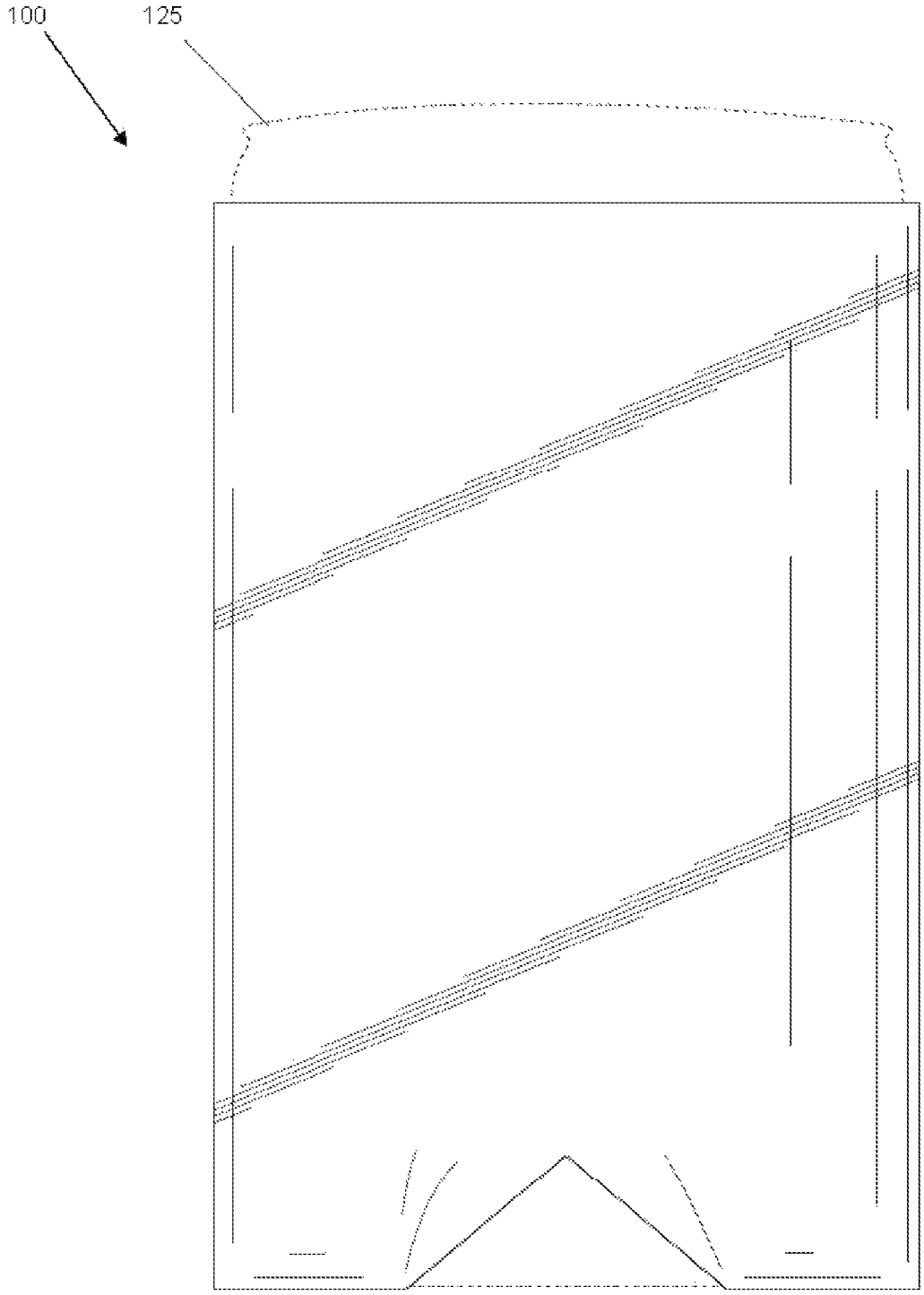
FIG. 18 is an alternate front view of the device of FIG. 1 according to embodiments of the present disclosure that features a pillow inserted into the device.
Figures 19, 20:
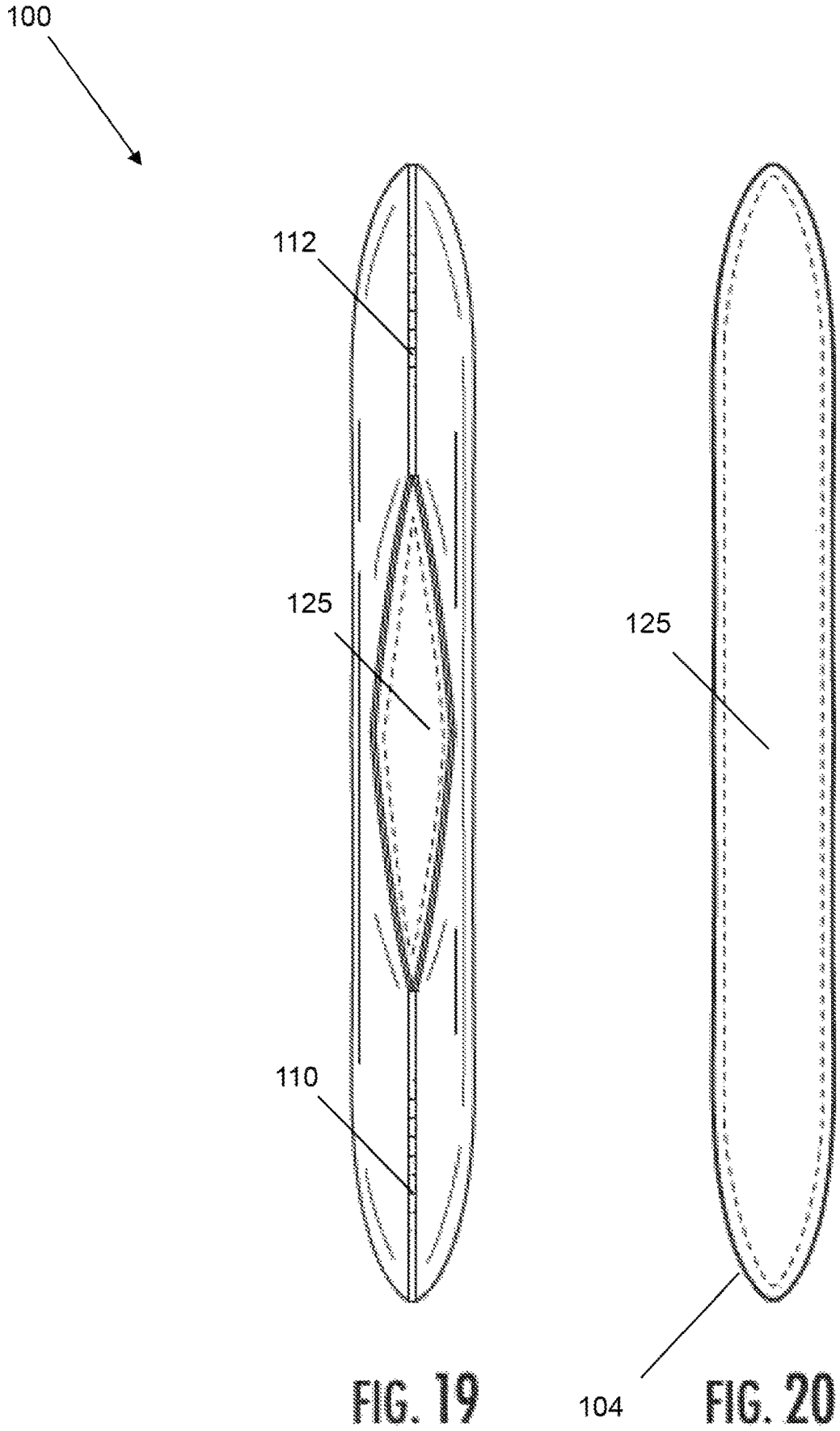
FIG. 19 is a top view of the device of FIG. 1 according to embodiments of the present disclosure that features a pillow inserted into the device.
FIG. 20 is a bottom view of the device of FIG. 1 according to embodiments of the present disclosure that features a pillow inserted into the device.
Figures 21, 22:
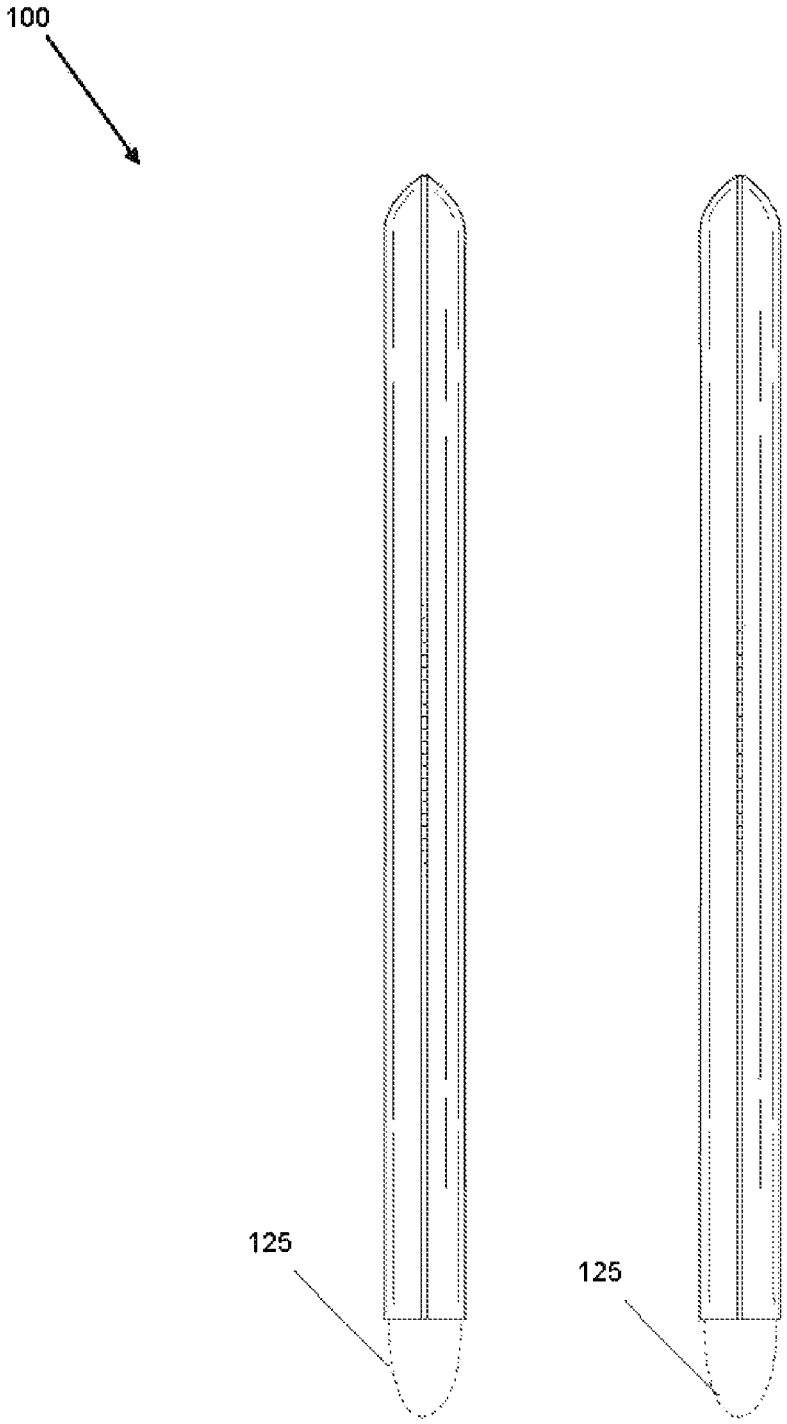
FIG. 21 is a right-side view of the device of FIG. 1 according to embodiments of the present disclosure that features a pillow inserted into the device.
FIG. 22 is a left side view of the device of FIG. 1 according to embodiments of the present disclosure that features a pillow inserted into the device.
Figure 23:
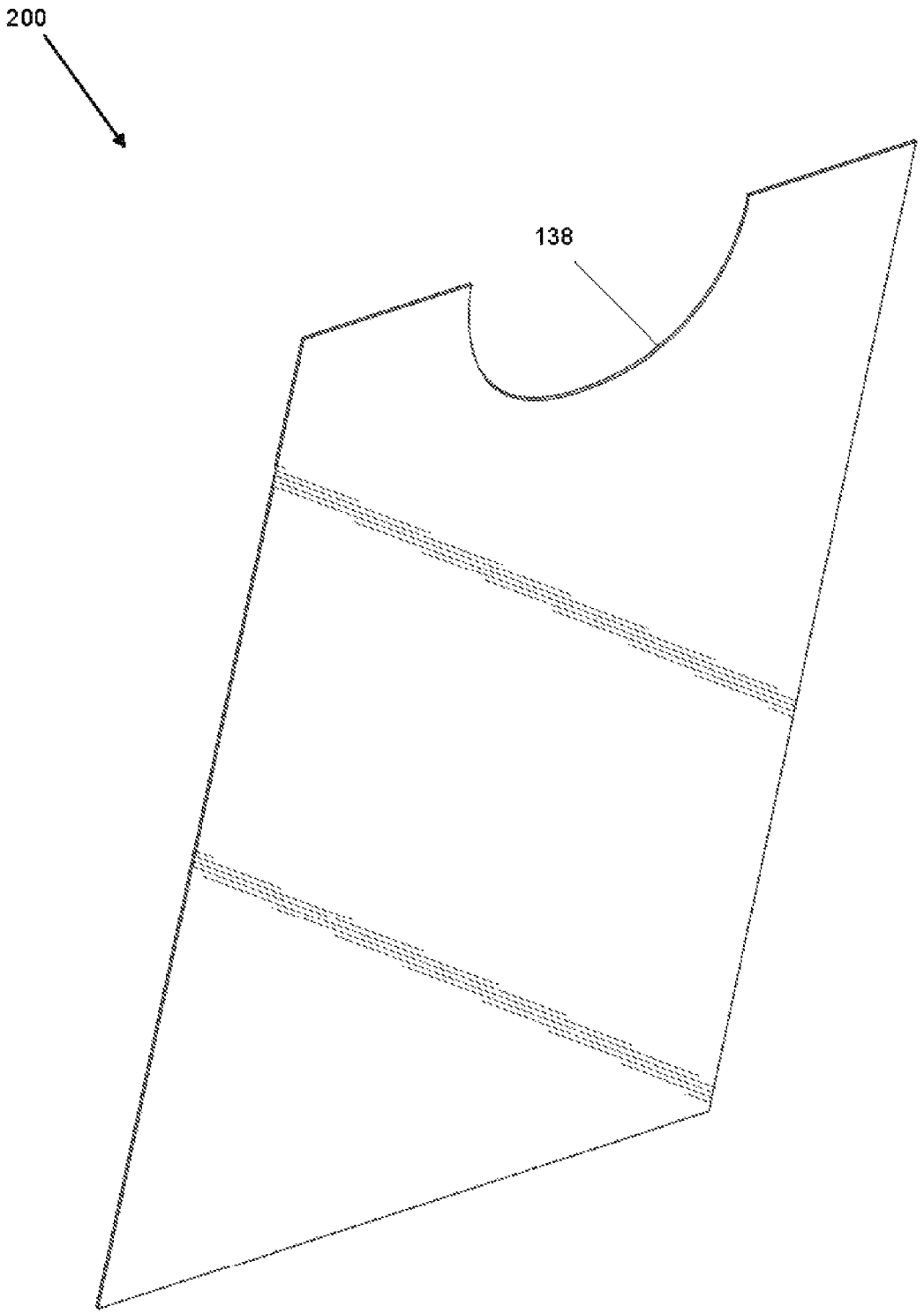
FIG. 23 is a front perspective view of a pillowcase positioning device for positioning a pillowcase on a pillow according to embodiments of the present disclosure.
Figure 24:
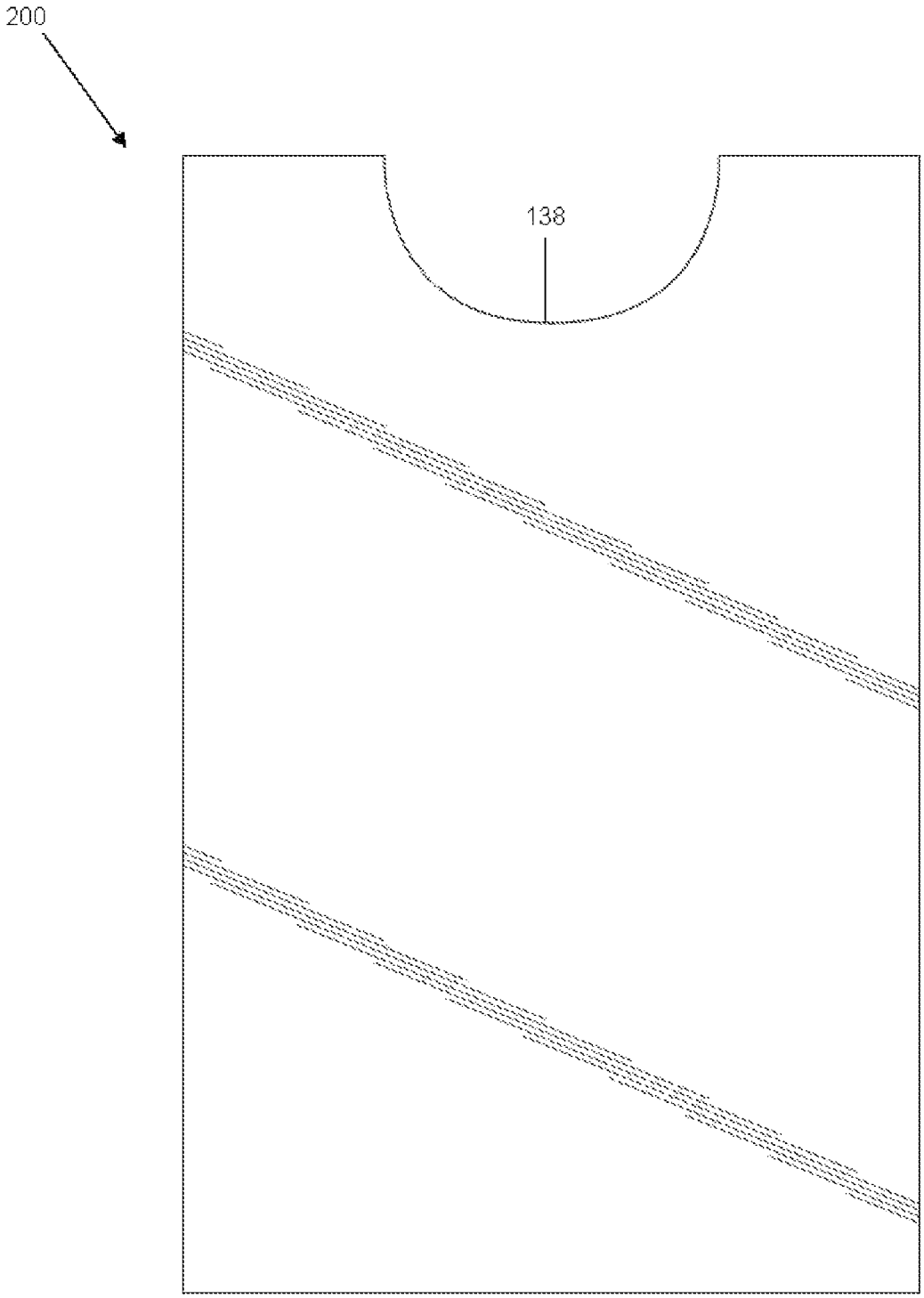
FIG. 24 is a front view of the device of FIG. 23 according to embodiments of the present disclosure.
Figure 25:
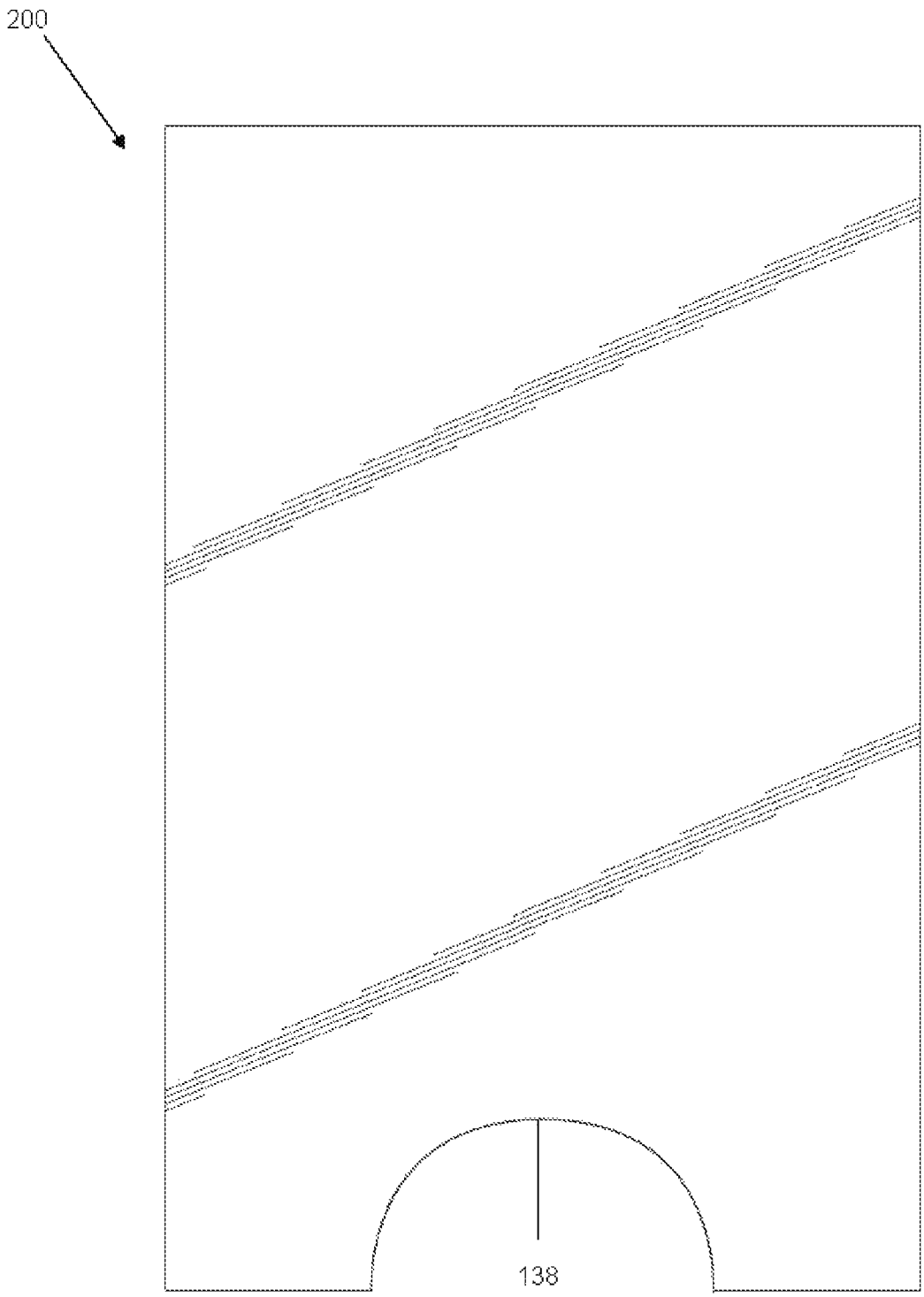
FIG. 25 is an alternative front view of the device of FIG. 23 according to embodiments of the present disclosure.
Figure 26:
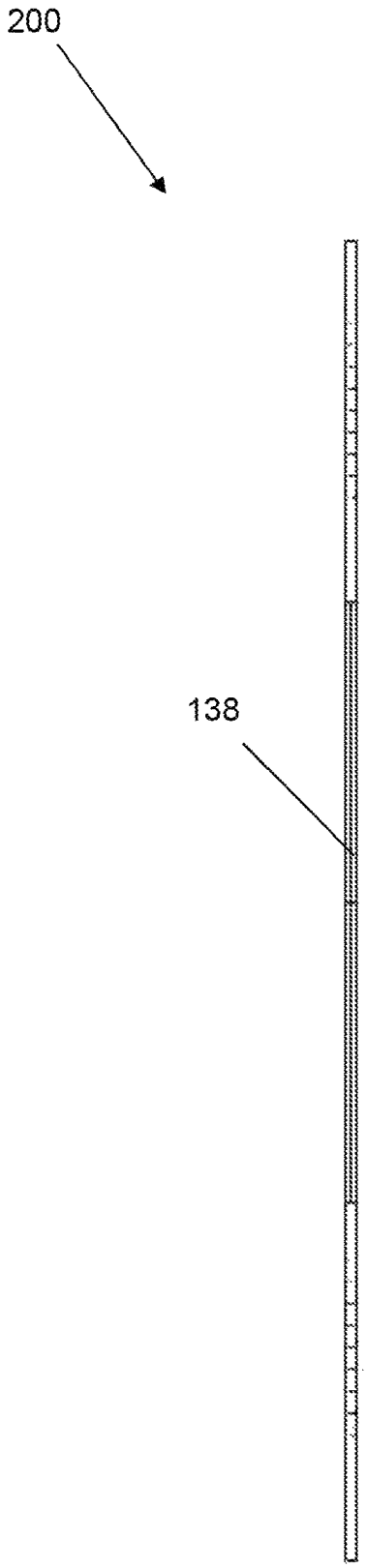
FIG. 26 is a top view of the device of FIG. 23 according to embodiments of the present disclosure.
Figure 27:
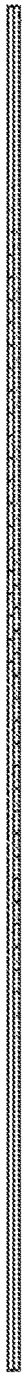
FIG. 27 is a bottom view of the device of FIG. 23 according to embodiments of the present disclosure.
Figures 28, 29:
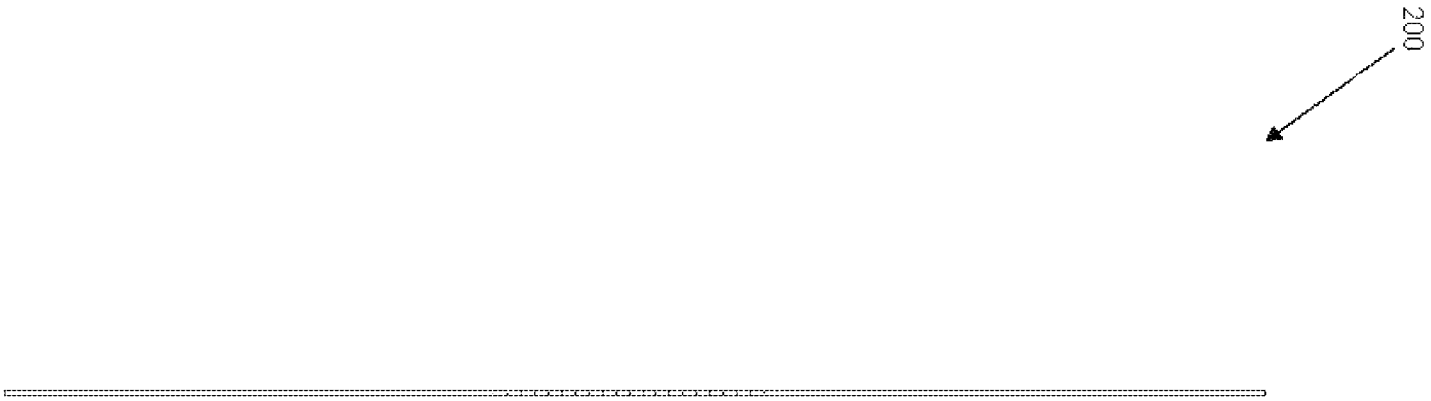
FIG. 28 is a right-side view of the device of FIG. 23 according to embodiments of the present disclosure.
FIG. 29 is a left side view of the device of FIG. 29 according to embodiments of the present disclosure.
Figure 30:
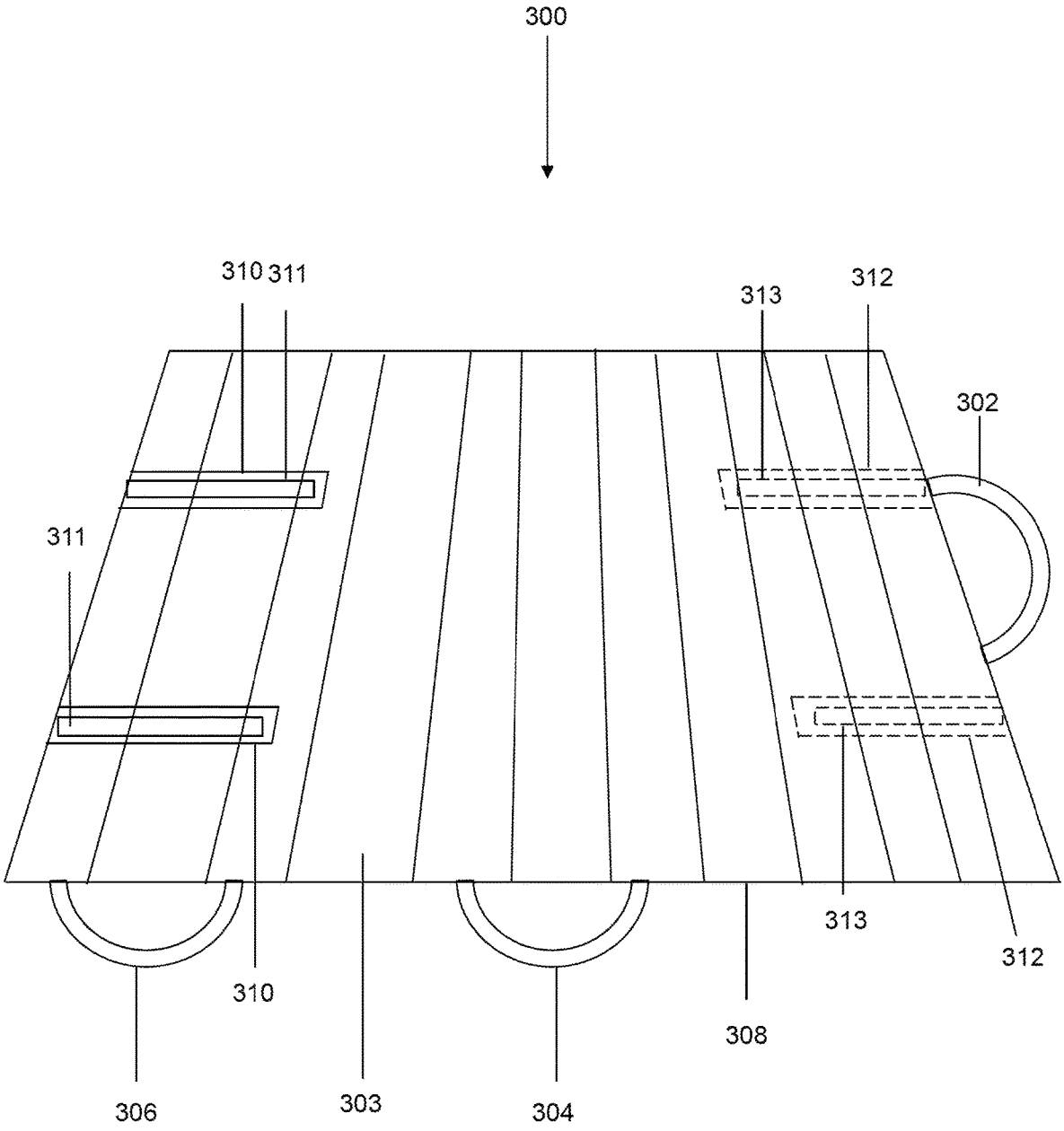
FIG. 30 is a front angled perspective view of a pillowcase positioning device for positioning a pillowcase on an object, such as a pillow, according to embodiments of the present disclosure.

As shown in FIGS. 1-22, embodiments of a device 100 for placing or positioning a case (e.g., a pillowcase) onto an object, such as a pillow, is disclosed. In certain embodiments, the device 100 may include a top portion 102, a bottom portion 104, a left side 106, a right side 108, a left shoulder portion 110, a right shoulder portion 112, a notch 114, a top opening 118, a bottom opening 105. The Figures also include a pillow 125 and a pillowcase 130 (e.g., as shown in FIG. 17). In certain embodiments, the device 100 may be made of plastic, vinyl, and/or any other suitable material (e.g. a low friction material) that will not readily snag onto a pillow 125 and/or a pillowcase 130. In certain embodiments, the left side 106 and the right side 108 may be sealed, the bottom base portion 104 may include a bottom opening 105, and the top portion 102 may include the left shoulder portion 110, the notch 114, the top opening 118, and the right shoulder portion 112. The left and right sides 106, 108, the left shoulder portion 110 and the right shoulder portion 112 may seal the front surface 130 of the device 100 to the bottom surface 132 of the device 100. In certain embodiments, the left shoulder portion 110 and the right shoulder portion 114 may be sealed using a perforated sealing mechanism such that when enough force is used to separate the front surface 130 from the bottom surface 132 the seals of the left shoulder portion 110 and the right shoulder portion 114 break and cause at least a portion of the bottom surface 132 and the front surface 130 to separate from each other.

As shown in FIGS. 16-22, a pillow 125 may be inserted into the bottom opening 105 located on the bottom base portion 104 of the device 100. The pillow 125 may be inserted far enough into the body of the device 100 such that the top end of the pillow contacts the left shoulder portion 110 and the right shoulder portion 114 and portion of the pillow is visible via the top opening 118 of the notch 114, as is shown in FIGS. 16-22. A pillowcase 130 may be positioned by a user over the device 100, such as is shown in FIG. 17. The user may then grab onto the portion of the pillow 125 under the pillowcase 130 that is exposed via the top opening 118 of the notch 114 with one hand, and grab onto the bottom of the device 100 near the bottom opening 105 of the bottom base portion 104. The user may then, in a single pulling motion, pull the bottom of the device 100 with enough force to cause the seals of the left and right shoulder portions 110, 112 to break, thereby causing the device 100 to be removed from being in between the pillowcase 130 and the pillow 125. This causes the pillowcase 130 to be perfectly positioned over the pillow 125 when the device 100 is removed. Notably, the present disclosure may include other device embodiments. For example, the device 200 illustrated in FIGS. 23-29 may operate in a similar fashion to the embodiment described in FIGS. 1-22, but may include a U-shaped notch 138 instead of a V-shaped notch 114.

The present disclosure may include still further embodiments. For example, as shown in FIGS. 30-34, another device 300 (e.g., a pillowcase positioning device) for placing or positioning a pillowcase 320 on a pillow 316 is shown. In certain embodiments, the device 100 may be rectangular, square-like, or any other shape. In certain embodiments, the device 300 may be made of vinyl, plastic, fabric, and/or any other material (e.g., a low friction material) that may assist in reducing friction when positioning the pillowcase 320 onto the pillow 316. The device 300 may also have a pair of handles 304, 306 (e.g. soft handles, hard handles, or other types of handles) located on a top portion (or end) of the device 300 and another handle 302 (e.g., side handle) located on at least one side portion of the device 300. In certain embodiments, additional handles 302 may be on the device 300 and on any side or surface of the device 300. In certain embodiments, the device 300 may be lifted and/or carried by using the handles 302, 304, 306. In certain embodiments, the body of the device 300 may include a plurality of portions 303 forming the body of the device 300. For example, the portions 303 may be slats of which there may be any number of portions 303 forming the body of the device 300. In certain embodiments, the portions 303 may be configured to have cardboard, foam, or other material contained within the portions 303 to give the device 300 a sturdier or softer feel and/or to adjust the rigidity or flexibility of the device 300. In certain embodiments, the device 300 may also have a fastening mechanism 310 (e.g. Velcro, etc.) on an inside portion of a left side of the device 300 and a fastening mechanism 312 (e.g. Velcro, etc.) on an outside portion of a right side of the device 300. In certain embodiments, any number of fastening mechanisms 310 and fastening mechanisms 312 may be utilized. In certain embodiments, the fastening mechanism 310 may include a fastening portion 311, which may be configured to secure to a fastening portion 313 of the fastening mechanism 312, such as when the left side is folded over and the right side is folded over and the left side is folded on top of the right side such that the fastening mechanisms 310 and 312 are aligned and are pressed or secured together.

Figure 31:
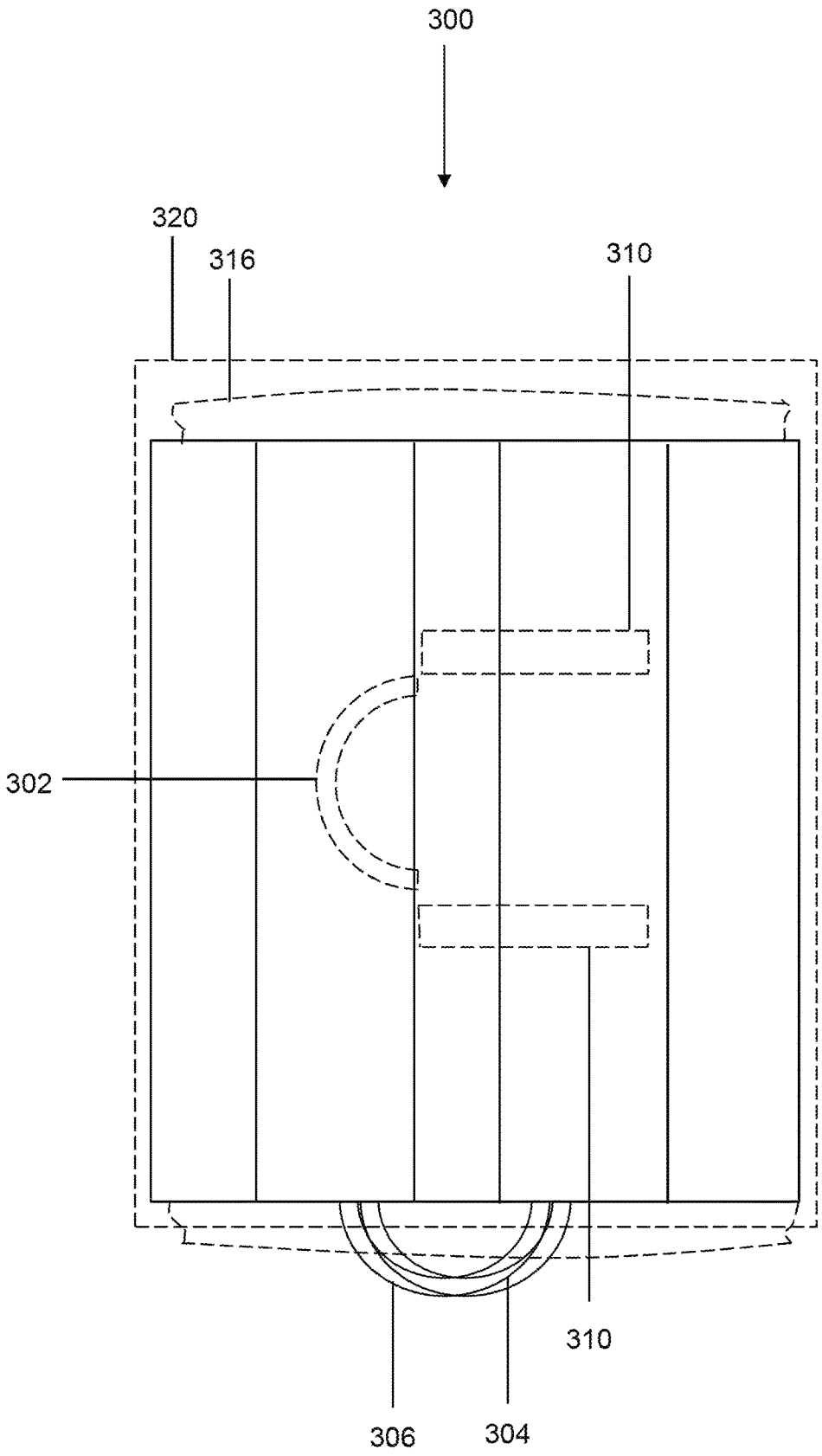
FIG. 31 is a top perspective view of the pillowcase positioning device of FIG. 30 according embodiments of the present disclosure that features the device in a connected state or closed configuration.

In certain embodiments, a pillow 316 may positioned onto the inside surface of the device 300 and the left side of the device 300 may be folded over the pillow 316 and the right side of the device 300 may be folded over as well. The fastening mechanism(s) 310 of the left side of the device 300 may be securely attached to the fastening mechanism)s 312 on the outside portion of the right side of the device 300 and the pillow 316 may be secured within the fastened device 300. In certain embodiments, any type of fastening portions 311, 313 may be utilized to fasten the fastening mechanisms 310, 312 together. For example, the fastening mechanisms 310, 312 may be hook and loop-style fastening mechanisms, where the fastening portion 311 may be the hook portion and the fastening portion 313 may be the loop portion or vice versa. When the hook portion and loop portions are pressed together, the hook portion secures to the loop portion, thereby causing the sides (or ends) of the device 300 to stay in a closed or secured configuration when folded on top of each other. In certain embodiments, other types of fastening mechanisms may also be utilized, such as, but not limited to, adhesives, cap and socket-style fasteners, stud and eyelet-style fasteners, laces, any type of fasteners or a combination thereof. Once the left and right sides are folded over and secured to each other via the fastening portions 311, 313 of the fastening mechanisms 310, 312 and the pillow is secured within the device 300, a pillowcase 130 may then be positioned easily over the device 300. In certain embodiments, the open end of the pillowcase 320 may be pulled over the device 300 and pillow 316 and moved across the device 300 until the sealed end of the pillowcase 320 is in proximity to the bottom portion (or end) of the device 300 and the bottom portion (or end) of the pillow 316. In certain embodiments, once pillow 316 and device 300 are within the pillowcase 320, the user may grab onto one or both of the handles 304, 306 located on the top portion (or end) of the device 300 and in proximity to the open end of the pillowcase 320 with one hand and may grab onto a portion of the pillow 316 in proximity to the bottom portion of device 300 and/or a portion of the bottom of the pillow 316 with another hand. In FIG. 31, for example, the bottom of the pillow 316 and the bottom portion of the device 300 are shown at the top of FIG. 31 and the top portion of the pillow 316 and the top portion of the device 300 are shown at the bottom of FIG. 31 (i.e., the pillow 316, the device and pillowcase 320 are oriented upside down in FIG. 31). Once the one or more handles 304, 306 are grabbed and the portion of the pillow 316 and/or bottom portion of the device 300 are grabbed, the user may then, in a single pulling motion, pull on one or more of the handle(s) 304, 306 while holding onto the portion of the pillow 316 and/or pillowcase 320 in proximity to the bottom portion of the device 300 to cause the device 300 to be removed away from the pillow 316 and the device 300, thereby causing the pillowcase 320 to be positioned on the pillow 316. In certain embodiments, the user may then put the device 300 back into an open configuration by unfastening the fastening mechanisms 310, 312 by separating the fastening portions 311, 313 from each other and folding the sides of the device 300 back down.

Figure 32:
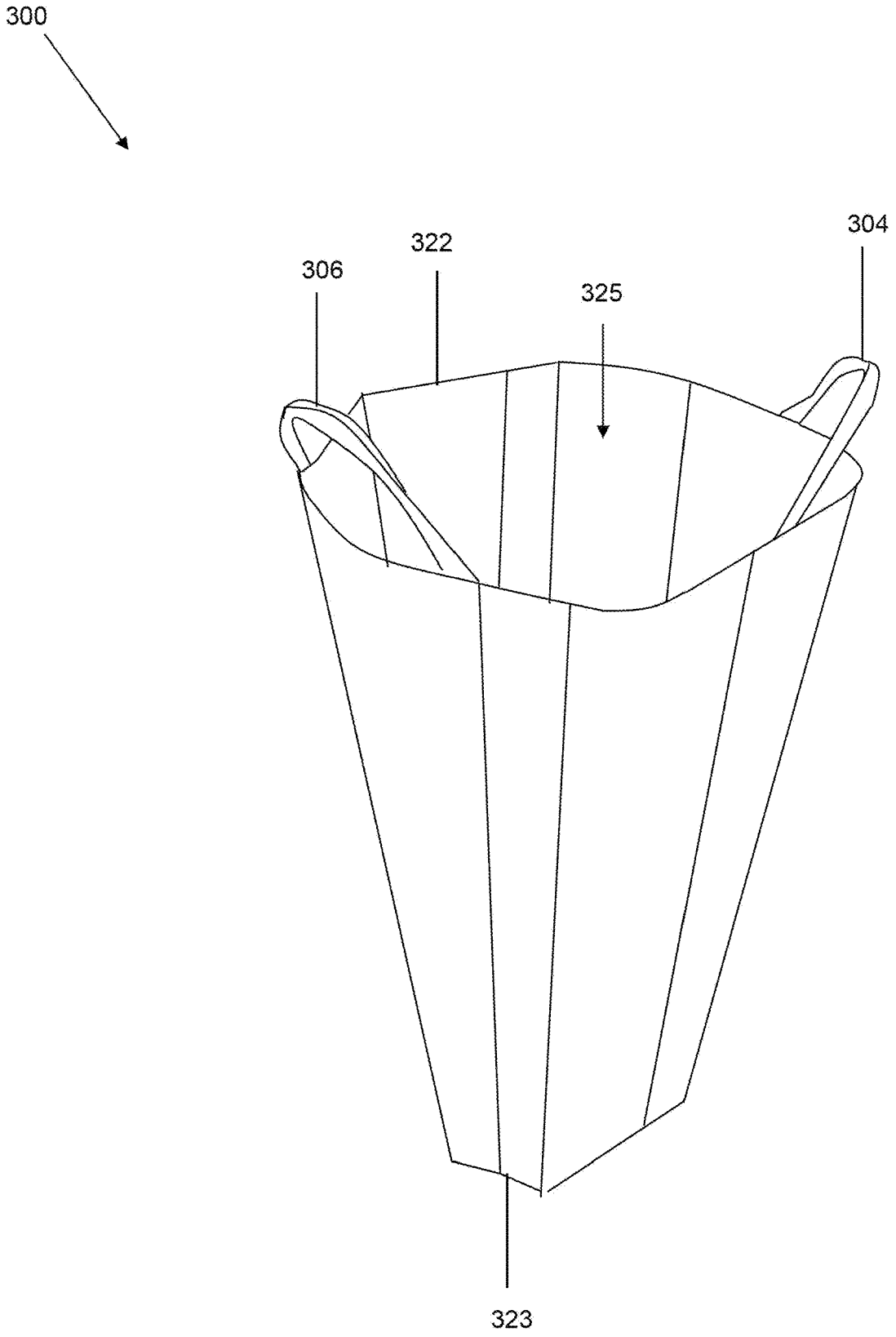
FIG. 32 is a front perspective view of the pillowcase positioning device of FIG. 30 where the pillowcase positioning device is converted into a storage device according to embodiments of the present disclosure.
Figure 33:
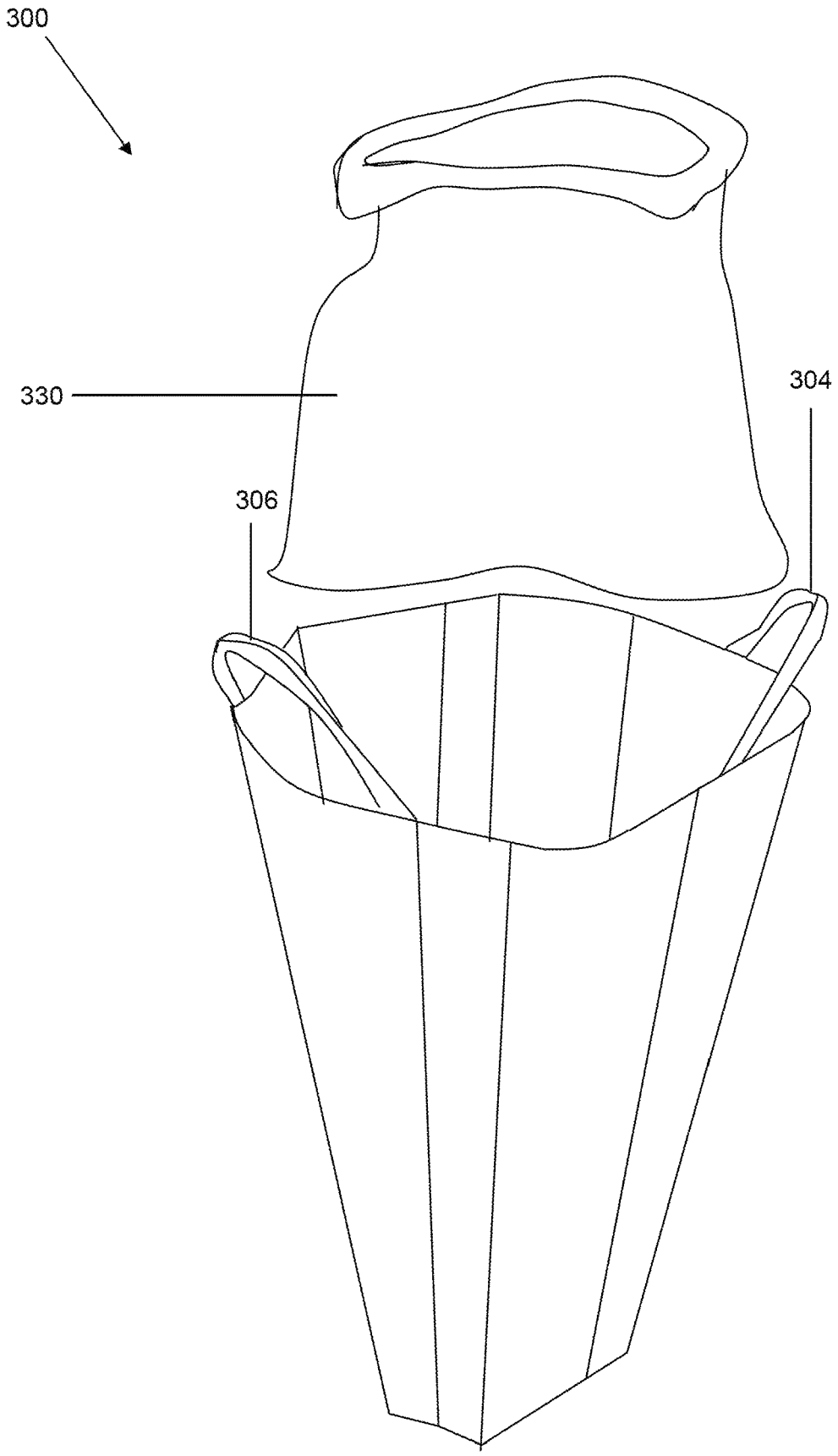
FIG. 33 is a front perspective view of the device of FIG. 30 where the pillowcase positioning device is converted into a storage device configured to receive a bag or liner according to embodiments of the present disclosure.
Figure 34:
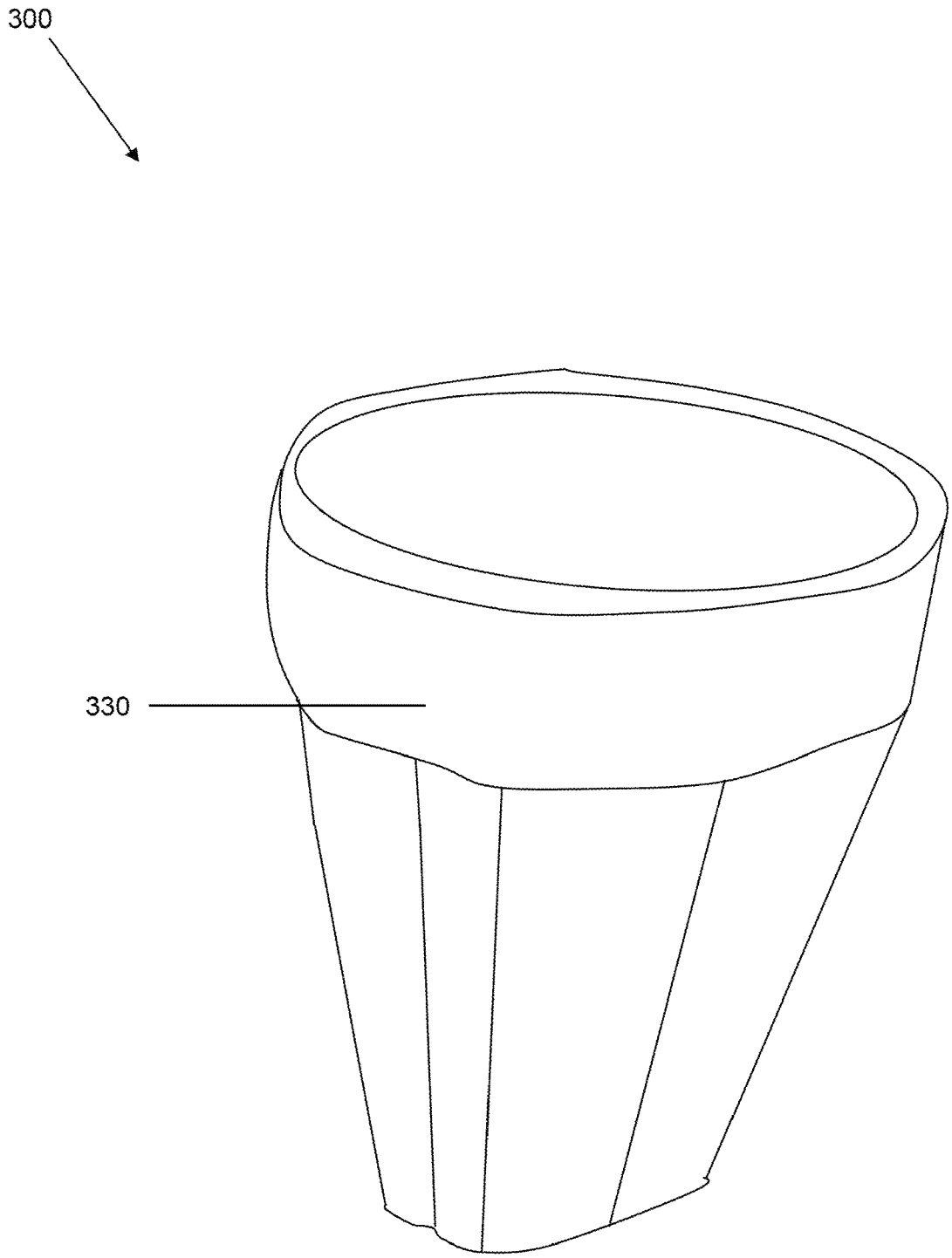
FIG. 34 is a front perspective view of the pillowcase positioning device of FIG. 30 where the pillowcase positioning device is converted into a storage device and includes a bag or liner according to embodiments of the present disclosure.
Figure 35:
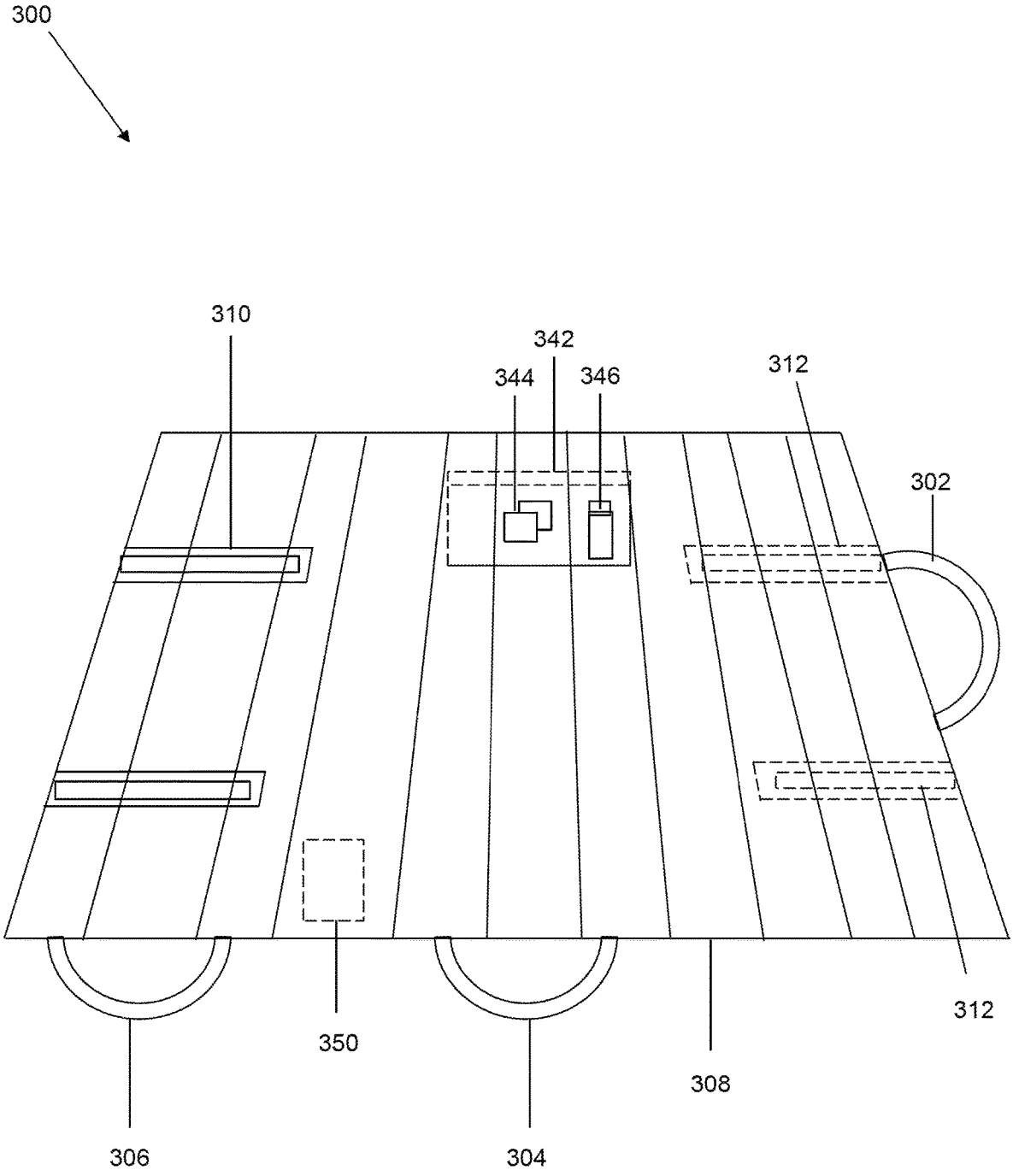
FIG. 35 is a front angled view of the device of FIG. 30 featuring a storage compartment and additional components according to embodiments of the present disclosure.

In certain embodiments, the device 300 may be configured to transform into a storage device (e.g. a laundry holder), as is shown in FIGS. 32-34. For example, when the fastening mechanism 310 of the left side of the device 300 is securely attached to the fastening mechanism 312 on the outside portion of the right side of the device 300, the device 300 may be turned on its side to create storage device when the pillow 316 is not contained therein, as is shown in FIGS. 32-34. For example, the bottom portion 323 of the device 300 may rest on a surface (e.g., the ground or other surface) and the top portion 322 of the device 300 may face away from the surface. In certain embodiments, the device 300 may lifted up using the handles 302, 304, 306 as is necessary as well. In certain embodiments, a pillowcase 130, 320, bag, and/or liner 330 may be inserted into the opening 325 of the device 300 and secured to the device 300 (e.g. by folding over a portion of the pillowcase 130, 320, bag, and/or liner 330 over a portion of the device's 300 surface (e.g., over a portion of the top portion 322)), as is shown in FIGS. 33-34 so that objects may be stored safely within the pillowcase 130, 300 bag, and/or liner secured to the device 300. In certain embodiments, a laundry linen bag may be inserted into the opening of the device 300 and may be secured to one or more surfaces of the device 300 and may be used to transport laundry to and from a laundry room, for example. In certain embodiments, the device 300 may be configured to include one or more storage compartments 342 secured to a surface of the device 300, which may be a pocket, a plastic sealable bag, any type of compartment, or a combination thereof. In certain embodiments, the one or more storage compartments 342 may be configured to store any type of objects 344. For example the one or more storage compartments 342 may include a cleaner 346, which may be utilized to clean the surfaces of the device 300 after use. The storage compartments 342 may be configured to store any types of objects 344 as well. In certain embodiments, other componentry 350 may also be incorporated into and/or onto the device 300. For example, exemplary componentry 350 may include a charging device that may include USB or other ports to charge devices, such as when the device is not being used. In certain embodiments, the componentry 350 may include a power source that may be plugged into by a separate device, such as an electronic device, that can draw power from the power source to charge the separate device. In certain embodiments, the componentry 350 may include a light (e.g., a light emitting diode), a battery pack to provide power (which may include a port to enable a battery to be charged by a wall socket or other power source), a speaker to emit sounds (e.g., when power of a battery pack is low or at full charge), a tracking device (e.g., a Bluetooth, Z-wave, or other device that can connect to a user's computing device, such as a mobile phone) that can let a user determine the location of the device 300, and/or any other componentry.

Although the Figures illustrates specific example configurations of the various components of the devices 100, 200, and 300, the devices 100, 200, and 300 may include any configuration of the components, which may include using a greater or lesser number of the components. For example, the devices 100 and 200 are illustrated as having a pair of shoulders 110, 112, a notch 114, a notch 138, an opening 118, an opening 105, a base 104, and left and right sides 106, 108. Notably, the devices 100 and 200 may be configured to include any number of shoulders 110, 112, notches 114, 138, openings 118, 105, bases 104, sides 106, 108, and/or any other components. Similarly, the device 300 may include any number of the components illustrated in the figures or as otherwise described in the present disclosure.

Figure 36:
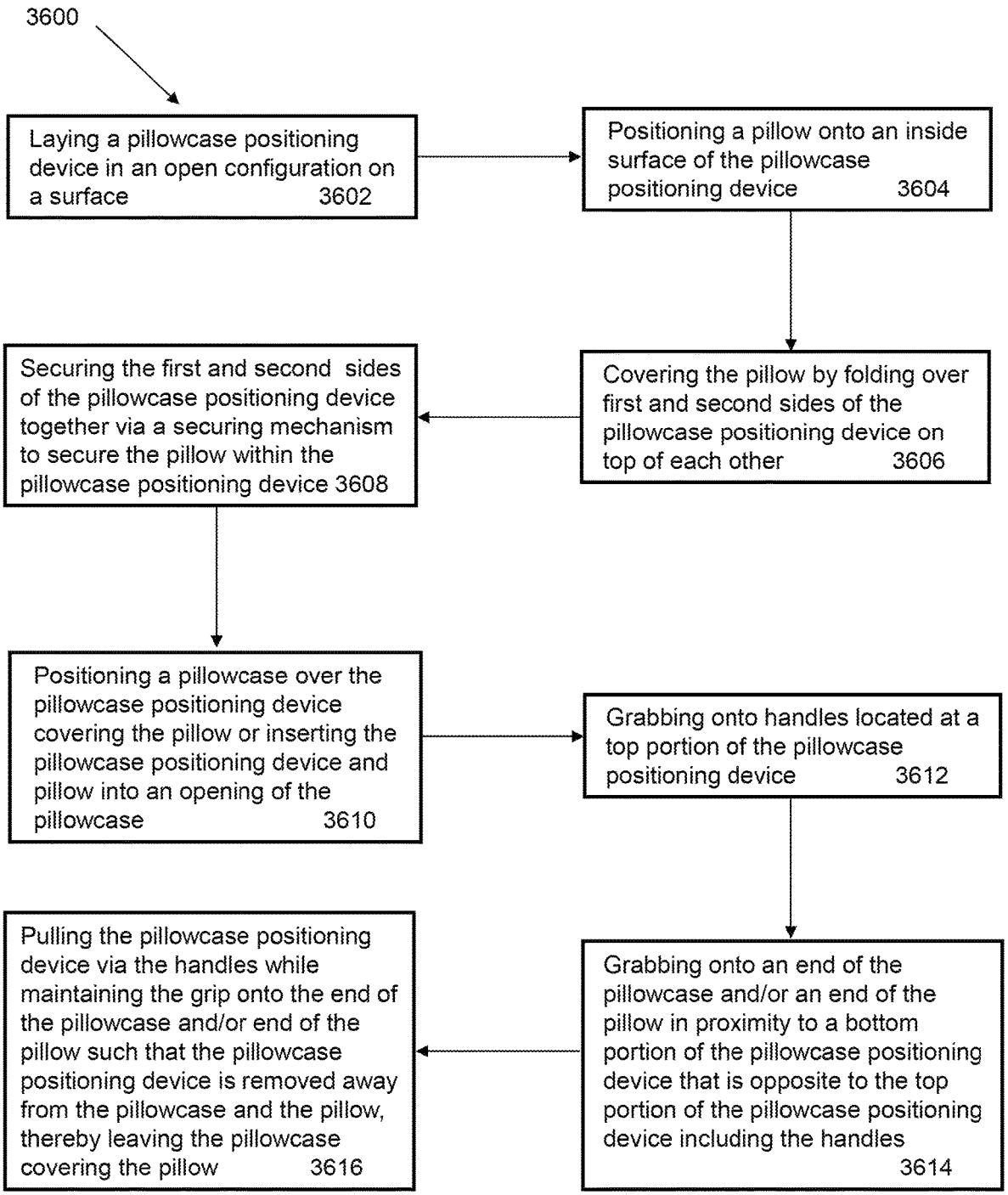
FIG. 36 is a flow diagram illustrating a sample method for utilizing a pillowcase positioning device for positioning or placing a case on an object, such as a pillow, according to embodiments of the present disclosure.

As shown in FIG. 36, an exemplary method 3600 for positioning or placing a case on an object, such as a pillow is schematically illustrated. In certain embodiments, the method 3600 may include, at step 3602, laying a pillowcase positioning device (e.g., device 300) in an open configuration on a surface. For example, the pillowcase positioning device may be placed flat in an open configuration (e.g., with fasteners not secured to each other) on a bed, a floor, a table, or any other surface. At step 3604, the method 3600 may include positioning a pillow onto an inside surface of the pillowcase positioning device. For example, a user may place the pillow on the inside surface (i.e., the side of the pillowcase positioning device facing upwards) of the pillowcase positioning device, such as in the center of the inside surface of the pillowcase positioning device. At step 3606, the method 3600 may include covering the pillow by folding over a first side of the pillowcase positioning device and a second side of the pillowcase positioning device. For example, the first side of the pillowcase positioning device may be folded over on top of the pillow, and the second side of the pillowcase positioning device may be folded over on top of the first side of the pillowcase positioning device so that both sides of the pillowcase positioning device are over the pillow.

In certain embodiments, the method 3600 may include, at step 3608, securing the first and second sides of the pillowcase positioning device together via a securing mechanism to secure the pillow within the pillowcase positioning device. For example, the first side may have fasteners 312 and the second side may have fasteners 310, which may be configured to connect with each other, such as by contacting the fasteners 312 with the fasteners 310. In certain embodiments, the fasteners 310, 312 may be Velcro-style fasteners, adhesives, cap and socket-style fasteners, stud and eyelet-style fasteners, laces, hook and loop fasteners, magnets, any type of fasteners or a combination thereof. In certain embodiments, the method 3600 may include, at step 3610, positioning a pillowcase over the pillowcase positioning device covering the pillow or inserting the pillowcase positioning device and covered pillow into an opening of the pillowcase so that the pillowcase is covering both the pillowcase positioning device and the pillow. At step 3612, the method 3600 may include grabbing onto one or more handles located at a top portion of the pillowcase positioning device. In certain embodiments, the closed end of the pillowcase may be covering the bottom portion of the pillowcase positioning device and the open end of the pillowcase may be in proximity to the top portion of the pillowcase positioning device. At step 3614, the method 3000 may include grabbing onto an end of the pillowcase (e.g., the closed end) and/or an end of the pillow covered by the end of the pillowcase (e.g., in proximity to a bottom portion of the pillowcase positioning device) that is opposite to the top portion of the pillowcase positioning device that includes the handles. At step 3616, the method 3000 may include pulling the pillowcase positioning device via the handles (e.g., the handles on the top portion of the pillowcase positioning device) while maintaining a grip onto the end of the pillowcase and/or the end of the pillow covered by the end of the pillowcase such that the pillowcase positioning device is removed away from the pillowcase and the pillow, thereby leaving the pillowcase covering the pillow.

In certain embodiments, use of the devices 100, 200, 300 may help to prevent should, elbow, wrist, and/or other body pain when positioning a pillowcase onto a pillow or a case onto an object in general. The devices 100, 200, 300 may assist in alleviating stress, arthritis, carpal tunnel syndrome, tennis elbow, or other conditions where stress on one's joints may be aggravated from the traditional pillowcase positioning methods. The devices 100, 200, 300 may also be utilized to prevent dust, dust mites, dander, hair, or other particles from being dispersed into the air because the pillowcase does not have to be shaken vigorously when positioning the pillowcase onto the pillow. The devices 100, 200, 300 also do not require a user to put her arm into the pillowcase to push the pillow into the pillowcase, thereby preventing the spread of body germs, oils, flaking skin, etc. The devices 100, 200, 300 may also assist a user that may have neck or upper spine stiffness because the devices 100, 200, 300 to not require a user to hold the pillow and/or pillowcase under the user's chin, which may stress the user's neck, jowl, or upper spine when attempting to pull a pillowcase over a pillow. The devices 100, 200, 300 also prolong the longevity of the pillow and pillowcase because the devices 100, 200, 300 do not cause the pillowcase and pillow to rub aggressively against each other when positioning the pillowcase onto the pillow (e.g., avoids tears, fraying, or unnecessary pulling). The devices 100, 200, 300 smoothly transfer a pillowcase onto a pillow in a stressless manner, while also minimizing stress to the user's body. In certain embodiments, the body of the devices 100, 200, 300 may be ¼ inches thick or less to make for easy storage. The materials utilized for the devices 100, 200, 300 may be hypoallergenic and non-toxic.

In certain embodiments, the devices 100, 200, 300 may include arrow lines drawn or printed onto the surface of the devices 100, 200, 300 to indicate the direction at which the pillowcase should be put over the devices 100, 200, 300. In certain embodiments, the one or more storage compartments 342 may be configured to store a card that may be utilized to document the date when a bed linen or pillowcase was changed so that a user knows when it has been too long and the pillowcase and/or bed linen need to be replaced. In certain embodiments, the devices 100, 200, 300 may include any number of fastening mechanisms located on any location of the surfaces of the devices 100, 200, 300 and the body of the devices may be made of any material that may enable the devices 100, 200, 300 to adjust to any size as necessary to fit any type or size of pillow and/or pillowcase. The material utilized for the devices 100, 200, 300 may be water-resistant, easily cleaned, or a combination thereof. In certain embodiments, the devices 100, 200, 300 may be utilized as a table on which activities, such as making crafts may be conducted. In certain embodiments, the devices 100, 200, 300 may be utilized as animal blankets or beds or for leak or urine protection.

The illustrations of arrangements described herein are intended to provide a general understanding of the structure of various embodiments, and they are not intended to serve as a complete description of all the elements and features of apparatus and systems that might make use of the structures described herein. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure is not limited to the particular arrangement(s) disclosed as the best mode contemplated for carrying out this invention, but that the invention will include all embodiments and arrangements falling within the scope of the appended claims.

The foregoing is provided for purposes of illustrating, explaining, and describing embodiments of this invention. Modifications and adaptations to these embodiments will be apparent to those skilled in the art and may be made without departing from the scope or spirit of this invention. Upon reviewing the aforementioned embodiments, it would be evident to an artisan with ordinary skill in the art that said embodiments can be modified, reduced, or enhanced without departing from the scope and spirit of the claims described below.

I claim:

1. A pillowcase positioning device, the pillowcase positioning device comprising:

a pair of handles located on a top portion of the pillowcase positioning device;

a side handle secured to a first side of the pillowcase positioning device, wherein the first side is of a body of the pillowcase positioning device;

a first fastener located on an inside portion of the first side of the pillowcase positioning device and extending from an end of the first side of the pillowcase positioning device across a first portion of the body of the pillowcase positioning device, wherein the first fastener is separate from the side handle; and a second fastener located on an outside portion of a second side of the body of the pillowcase positioning device and extending from an end of the second side of the pillowcase positioning device across a second portion of the body of the pillowcase positioning device, wherein the second fastener is separate from the first fastener and is positioned collinear with respect to the first fastener, wherein a pillow is configured to be positioned on an inside surface of the pillowcase positioning device, wherein the first side is folded over the pillow and the second side is folded over the pillow, wherein the first fastener is secured to the second fastener to secure the pillow within the pillow positioning device, wherein a pillowcase is configured to be positioned over the pillowcase positioning device while the pillow is within the pillow positioning device, wherein when at least one handle of the pair of handles is grabbed and pulled while grabbing onto a portion of the pillow or a portion of the pillowcase located opposite the pair of handles, the pillowcase positioning device is removed away from the pillow and the pillowcase, thereby leaving the pillowcase positioned over the pillow.

2. The pillowcase positioning device of claim 1, wherein a first handle of the pair of handles is located in proximity to an end of the top portion, and wherein the second handle of the pair of handles is located in proximity to a center of the top portion.

3. The pillowcase positioning device of claim 1, wherein the side handle is located in proximity to a center of the first side of the pillowcase positioning device.

4. The pillowcase positioning device of claim 1, further comprising a plurality of slats configured to be adjacent to each other and configured to form the pillowcase positioning device.

5. The pillowcase positioning device of claim 1, further comprising a third fastener located on the inside portion of the first side and parallel to the first fastener.

6. The pillowcase positioning device of claim 5, further comprising a fourth fastener located on the outside portion of the second side and parallel to the second fastener.

7. The pillowcase positioning device of claim 6, wherein the third fastener is configured to secure to the fourth fastener.

8. The pillowcase positioning device of claim 1, wherein, when the first side is folded over the pillow and the second side is folded over the pillow and the first fastener is secured to the second fastener to secure the pillow within the pillow positioning device, the pillowcase positioning device is in a closed configuration.

9. The pillowcase positioning device of claim 1, wherein, when the first side is not folded over the pillow and the second side is not folded over the pillow and the first and second fasteners are not secured to each other, the pillowcase positioning device is in an open configuration.

10. The pillowcase positioning device of claim 1, wherein the pillowcase positioning device is configured to be carried via the pair of handles, the side handle, or a combination thereof.

11. The pillowcase positioning device of claim 1, wherein the pillowcase positioning device is configured to serve as a storage device when the first side is folded over and the second side is folded under the first side and the first fastener is secured to the second fastener to secure the first side to the second side such that the pillowcase positioning device is in a closed configuration, and the pillowcase positioning device is placed on a surface via a bottom portion opposite to the top portion.

12. The pillowcase positioning device of claim 1, further comprising a sealable storage compartment configured to store an article.

13. The pillowcase positioning device of claim 1, further comprising a universal serial bus charger, a power source, or a combination thereof.

14. A method, comprising:

laying a pillowcase positioning device in an open configuration on a surface;

positioning a pillow onto an inside surface of the pillowcase positioning device;

covering the pillow by folding over first and second sides of the pillowcase positioning device on top of each other;

securing the first and second sides of a body of the pillowcase positioning device together via a first fastener and a second fastener to secure the pillow within the pillowcase positioning device, wherein the first fastener is located on an inside portion of the first side of the device and extends from an end of the first side of the pillowcase positioning device across a first portion of a body of the pillowcase positioning device, wherein the first fastener is separate from a side handle located on the first side or the second side of the pillowcase positioning device, wherein the second fastener is located on an outside portion of the second side of the body of the pillowcase positioning device and extends from an end of the second side of the pillowcase positioning device across a second portion of the body of the pillowcase positioning device, wherein the second fastener is separate from the first fastener and is positioned collinear with respect to the first fastener;

grabbing onto at least one handle located at a top portion of the pillowcase positioning device;

grabbing onto an end of the pillowcase, an end of the pillow, or a combination thereof, that are in proximity to a bottom portion of the pillowcase positioning device that is opposite to the top portion; and pulling the pillowcase positioning device via the at least one handle while maintaining a grip onto the end of the pillowcase, the end of the pillow, or a combination thereof, such that the pillowcase positioning device is removed away from the pillowcase and the pillow, thereby leaving the pillowcase covering the pillow.

15. The method of claim 14, further comprising unfastening the first and second sides of the pillowcase positioning device after pulling the pillowcase positioning device via the at least one handle.

16. The method of claim 14, further comprising inserting a different pillow into the pillowcase positioning device after pulling the pillowcase positioning device away from the pillow.

17. The method of claim 14, further comprising adjusting a position of the pillowcase positioning device such that the bottom portion is resting on the surface and so that the pillowcase positioning device is in an upright position.

18. The method of claim 17, further comprising positioning a liner or bag into an opening of the pillowcase positioning device while in the upright position, wherein the liner or bag is configured to receive an article.

19. The method of claim 14, further comprising carrying the pillowcase positioning device via the side handle located on the first side or the second side of the pillowcase positioning device.

20. A pillowcase positioning device, the pillowcase positioning device comprising:

at least one handle located on a top portion of the pillowcase positioning device;

a first fastener located on an inside portion of a first side of a body of the pillowcase positioning device and extending from an end of the first side of the pillowcase positioning device across a first portion of the body of the pillowcase positioning device, wherein the first fastener is separate from a side handle secured to the first side of the pillowcase positioning device; and a second fastener located on an outside portion of a second side of the pillowcase positioning device and extending from an end of the second side of the pillowcase positioning device across a second portion of the body of the pillowcase positioning device, wherein the second fastener is separate from the first fastener and is positioned collinear with respect to the first fastener, wherein a pillow is configured to be positioned on an inside surface of the pillowcase positioning device, wherein the first side is folded over the pillow and the second side is folded over the pillow, wherein the first fastener is secured to the second fastener such that the pillowcase positioning device is in a closed configuration and the pillow is secured within the pillow positioning device, wherein a pillowcase is configured to be positioned over the pillowcase positioning device while the pillow is within the pillow positioning device, wherein when the at least one handle is grabbed and pulled while grabbing onto a portion of the pillow or a portion of the pillowcase located opposite the at least one handle, the pillowcase positioning device is removed away from the pillow and the pillowcase, thereby leaving the pillowcase positioned over the pillow.

* * * * *